US008636054B2

(12) United States Patent
Smithson et al.

(10) Patent No.: US 8,636,054 B2
(45) Date of Patent: Jan. 28, 2014

(54) POSITION INDICATING MULTIPLEXED CONTROL SYSTEM AND METHOD FOR DOWNHOLE WELL TOOLS

(75) Inventors: Mitchell C. Smithson, Pasadena, TX (US); Brett W. Bouldin, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 659 days.

(21) Appl. No.: 12/921,741

(22) PCT Filed: Sep. 9, 2009

(86) PCT No.: PCT/US2009/056339

§ 371 (c)(1),
(2), (4) Date: Sep. 9, 2010

(87) PCT Pub. No.: WO2010/030648

PCT Pub. Date: Mar. 18, 2010

(65) Prior Publication Data

US 2011/0056288 A1 Mar. 10, 2011

(51) Int. Cl.
*E21B 47/09* (2012.01)
*E21B 23/00* (2006.01)

(52) U.S. Cl.
USPC ..... 166/65.1; 166/66; 166/381

(58) Field of Classification Search
USPC ..... 166/65.1, 66, 381, 255.1
See application file for complete search history.

(56) References Cited

U.S. PATENT DOCUMENTS 3,105,551 A 10/1963 Ehlert
3,353,594 A * 11/1967 Lewis ..... 166/336
3,430,712 A 3/1969 Stafford
3,565,189 A 2/1971 Hart
3,575,650 A 4/1971 Fengler
3,717,095 A 2/1973 Vann
3,906,328 A 9/1975 Wenrich et al.
4,467,833 A 8/1984 Satterwhite
5,156,220 A 10/1992 Forehand et al.
5,251,703 A 10/1993 Skinner
5,547,029 A 8/1996 Rubbo et al.

(Continued)

FOREIGN PATENT DOCUMENTS

WO 0029717 A2 5/2000
WO 2009038590 A1 3/2009
WO 2010030266 A1 3/2010

OTHER PUBLICATIONS

Canadian Office Action issued Aug. 1, 2012 for CA Patent Application No. 2,735,367, 2 pages.

(Continued)

*Primary Examiner* — Shane Bomar
*Assistant Examiner* — Catherine Loikith
(74) *Attorney, Agent, or Firm* — Smith IP Services, P.C.

(57) ABSTRACT

Position indication in multiplexed downhole well tools. A method of selectively actuating and indicating a position in a well includes selecting at least one well tool from among multiple well tools for actuation by flowing direct current in one direction through a set of conductors in the well, the well tool being deselected for actuation when direct current flows through the set of conductors in an opposite direction; and detecting a varying resistance across the set of conductors as the selected well tool is actuated, the variation in resistance providing an indication of a position of a portion of the selected well tool.

15 Claims, 17 Drawing Sheets

(56) References Cited

U.S. PATENT DOCUMENTS

| | | | | |
|---|---|---|---|---|
| 5,666,050 | A | 9/1997 | Bouldin et al. | |
| 6,247,536 | B1 | 6/2001 | Leismer et al. | |
| 6,315,049 | B1 | 11/2001 | Hickey et al. | |
| 7,145,471 | B2 | 12/2006 | Purkis et al. | |
| 7,673,683 | B2 | 3/2010 | Gissler | |
| 7,779,912 | B2 | 8/2010 | Gissler | |
| 8,196,656 | B2 * | 6/2012 | Gissler | 166/255.1 |
| 8,322,446 | B2 * | 12/2012 | Smithson et al. | 166/373 |
| 2001/0054505 | A1 | 12/2001 | Carmody et al. | |
| 2002/0014338 | A1 | 2/2002 | Purkis et al. | |
| 2002/0027002 | A1 | 3/2002 | Carmody et al. | |
| 2009/0071717 | A1 | 3/2009 | Gissler | |
| 2010/0059233 | A1 | 3/2010 | Smithson et al. | |
| 2011/0067854 | A1 | 3/2011 | Love et al. | |

OTHER PUBLICATIONS

Office Action issued Mar. 7, 2012 for U.S. Appl. No. 12/555,451, 10 pages.

Advisory Action issued May 14, 2012 for U.S. Appl. No. 12/555,451, 3 pages.

International Preliminary Report on Patentability issued Mar. 10, 2011, for International Patent Application No. PCT/US08/074744, 6 pages.

International Preliminary Report on Patentability issued Mar. 24, 2011, for International Patent Application No. PCT/US09/056339, 7 pages.

International Preliminary Report on Patentability issued Mar. 24, 2011, for International Patent Application No. PCT/US08/075668, 6 pages.

International Preliminary Report on Patentability issued Apr. 1, 2010, for PCT Patent Application No. PCT/US07/079945, 7 pages.

Office Action issued Oct. 5, 2011 for U.S. Appl. No. 12/555,451, 23 pages.

Office Action issued Nov. 21, 2011 for U.S. Appl. No. 12/206,291, 25 pages.

Australian Examiner's First report issued Nov. 21, 2011 for AU Patent Application No. 2009291933, 2 pages.

* cited by examiner

POSITION INDICATING MULTIPLEXED CONTROL SYSTEM AND METHOD FOR DOWNHOLE WELL TOOLS

CROSS-REFERENCE TO RELATED APPLICATIONS

This application is a national stage application under 35 USC §371 of International Application No. PCT/US09/56339 filed on Sep. 9, 2009, and which claims the benefit of the filing date of International Patent Application No. PCT/US08/75668 filed on Sep. 9, 2008. The entire disclosures of these prior applications are incorporated herein by this reference.

BACKGROUND

The present disclosure relates generally to operations performed and equipment utilized in conjunction with a subterranean well and, in an embodiment described herein, more particularly provides for position indication in multiplexed downhole well tools.

It is useful to be able to selectively actuate well tools in a subterranean well. For example, production flow from each of multiple zones of a reservoir can be individually regulated by using a remotely controllable choke for each respective zone. The chokes can be interconnected in a production tubing string so that, by varying the setting of each choke, the proportion of production flow entering the tubing string from each zone can be maintained or adjusted as desired.

It is also useful to be able determine a configuration of an actuated well tool. For example, the setting of a choke should be known, so that the flow through the choke can be determined and adjusted as appropriate.

Therefore, it will be appreciated that advancements in the art of remotely actuating downhole well tools and indicating position of those tools are needed. Such advancements would preferably reduce the number of lines, wires, etc. installed, and would preferably reduce or eliminate the need for downhole electronics.

SUMMARY

In carrying out the principles of the present disclosure, systems and methods are provided which solve at least one problem in the art. One example is described below in which a relatively large number of well tools may be selectively actuated using a relatively small number of lines, wires, etc. Another example is described below in which a voltage across a set of conductors is used to determine a position of a portion of an actuated well tool.

In one aspect, a method of selectively actuating and indicating a position in a well is provided. The method includes the steps of: selecting at least one well tool from among multiple well tools for actuation by flowing direct current in a first direction through a set of conductors in the well, the well tool being deselected for actuation when direct current flows through the set of conductors in a second direction opposite to the first direction; and detecting a varying resistance across the set of conductors as the selected well tool is actuated. The variation in resistance provides an indication of a position of a portion of the selected well tool.

In another aspect, a system for selectively actuating from a remote location multiple downhole well tools in a well is provided. The system includes multiple electrical conductors in the well; multiple control devices that control which of the well tools is selected for actuation in response to current flow in at least one set of the conductors, at least one direction of current flow in the at least one set of conductors being operative to select a respective at least one of the well tools for actuation; and multiple position indicators. Each position indicator is operative to indicate a position of a portion of a respective one of the well tools.

These and other features, advantages, benefits and objects will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
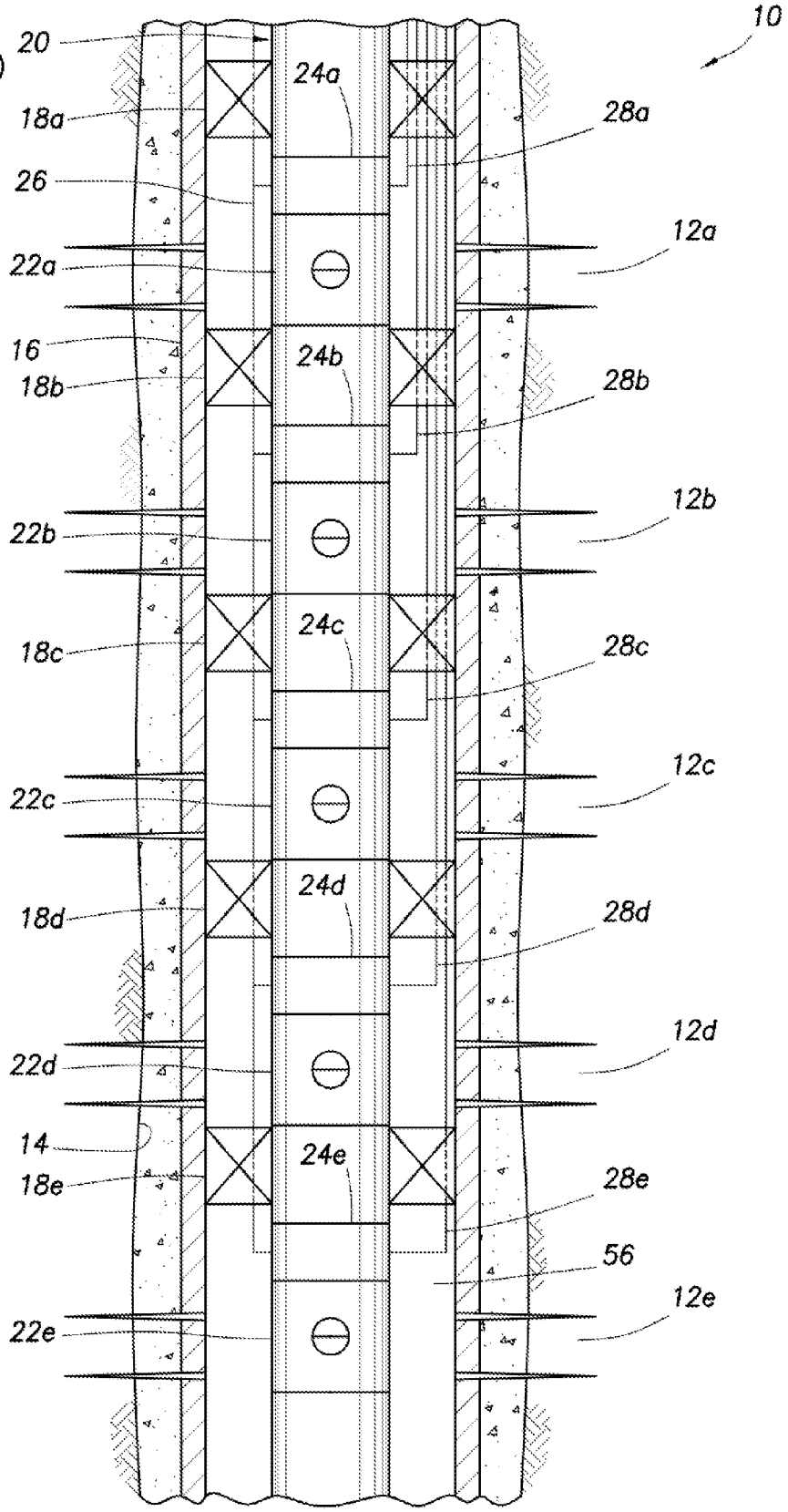
FIG. 1 (PRIOR ART)
FIG. 1 is a schematic view of a prior art well control system.

Representatively illustrated in FIG. 1 is a well control system 10 which is used to illustrate the types of problems overcome by the systems and methods of the present disclosure. Although the drawing depicts prior art concepts, it is not meant to imply that any particular prior art well control system included the exact configuration illustrated in FIG. 1.

The control system 10 as depicted in FIG. 1 is used to control production flow from multiple zones 12*a-e* intersected by a wellbore 14. In this example, the wellbore 14 has been cased and cemented, and the zones 12*a-e* are isolated within a casing string 16 by packers 18*a-e* carried on a production tubing string 20.

Fluid communication between the zones 12*a-e* and the interior of the tubing string 20 is controlled by means of flow control devices 22*a-e* interconnected in the tubing string. The flow control devices 22*a-e* have respective actuators 24*a-e* for actuating the flow control devices open, closed or in a flow choking position between open and closed.

In this example, the control system 10 is hydraulically operated, and the actuators 24*a-e* are relatively simple piston-and-cylinder actuators. Each actuator 24*a-e* is connected to two hydraulic lines—a balance line 26 and a respective one of multiple control lines 28*a-e*. A pressure differential between the balance line 26 and the respective control line 28*a-e* is applied from a remote location (such as the earth's surface, a subsea wellhead, etc.) to displace the piston of the corresponding actuator 24*a-e* and thereby actuate the associated flow control device 22*a-e*, with the direction of displacement being dependent on the direction of the pressure differential.

There are many problems associated with the control system 10. One problem is that a relatively large number of lines 26, 28*a-e* are needed to control actuation of the devices 22*a-e*. These lines 26, 28*a-e* must extend through and be sealed off at the packers 18*a-e*, as well as at various bulkheads, hangers, wellhead, etc.

Another problem is that it is difficult to precisely control pressure differentials between lines extending perhaps a thousand or more meters into the earth. This will lead to improper or unwanted actuation of the devices 22*a-e*, as well as imprecise regulation of flow from the zones 12*a-e*.

Attempts have been made to solve these problems by using downhole electronic control modules for selectively actuating the devices 22*a-e*. However, these control modules include sensitive electronics which are frequently damaged by the hostile downhole environment (high temperature and pressure, etc.).

Furthermore, electrical power must be supplied to the electronics by specialized high temperature batteries, by downhole power generation or by wires which (like the lines 26, 28*a-e*) must extend through and be sealed at various places in the system. Signals to operate the control modules must be supplied via the wires or by wireless telemetry, which includes its own set of problems.

Thus, the use of downhole electronic control modules solves some problems of the control system 10, but introduces other problems. Likewise, mechanical and hydraulic solutions have been attempted, but most of these are complex, practically unworkable or failure-prone.

Figure 2:
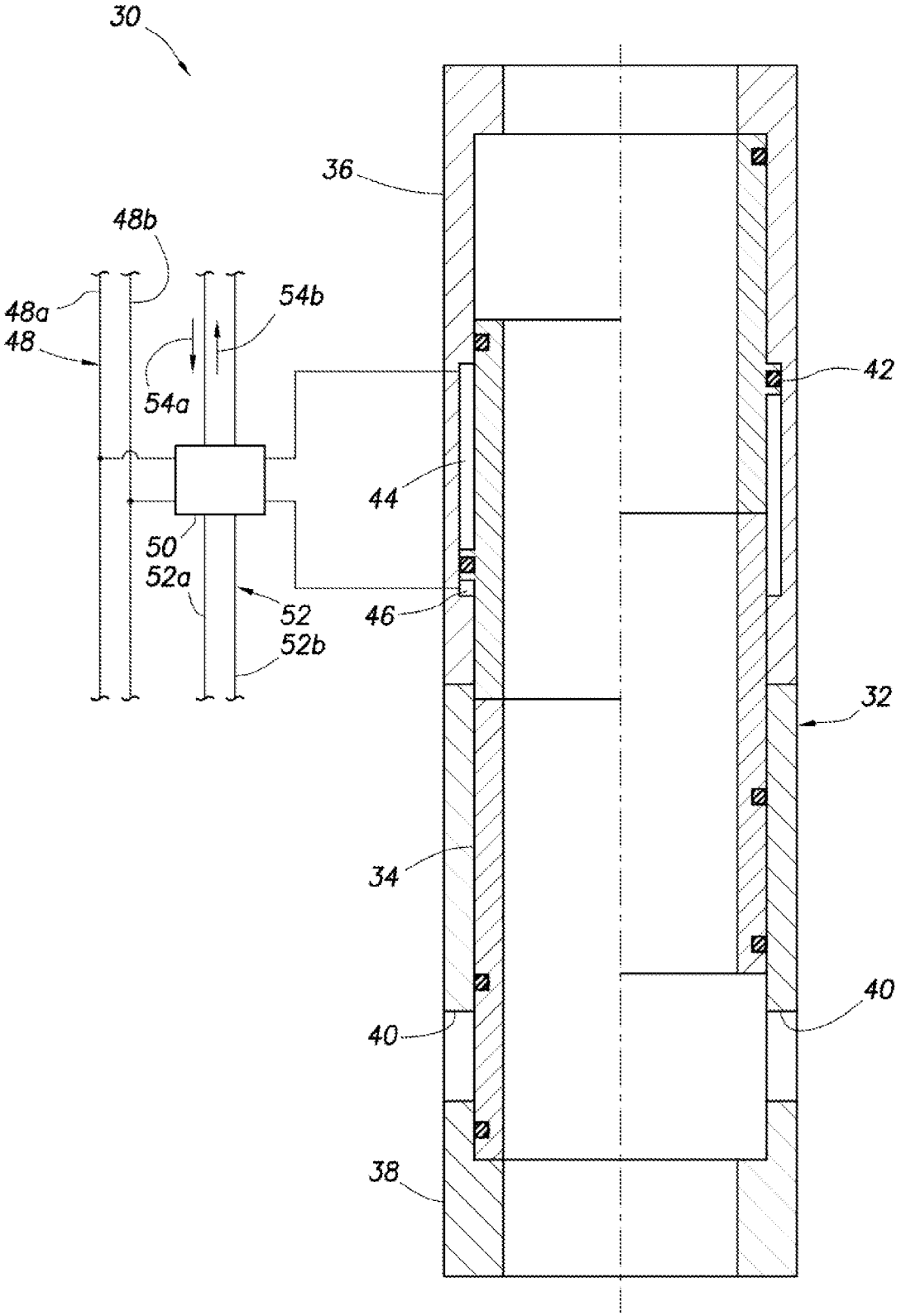
FIG. 2 is an enlarged scale schematic view of a flow control device and associated control device which embody principles of the present disclosure.

Turning now to FIG. 2, a system 30 and associated method for selectively actuating multiple well tools 32 are representatively illustrated. Only a single well tool 32 is depicted in FIG. 2 for clarity of illustration and description, but the manner in which the system 30 may be used to selectively actuate multiple well tools is described more fully below.

The well tool 32 in this example is depicted as including a flow control device 38 (such as a valve or choke), but other types or combinations of well tools may be selectively actuated using the principles of this disclosure, if desired. A sliding sleeve 34 is displaced upwardly or downwardly by an actuator 36 to open or close ports 40. The sleeve 34 can also be used to partially open the ports 40 and thereby variably restrict flow through the ports.

The actuator 36 includes an annular piston 42 which separates two chambers 44, 46. The chambers 44, 46 are connected to lines 48*a,b* via a control device 50. D.C. current flow in a set of electrical conductors 52*a,b* is used to select whether the well tool 32 is to be actuated in response to a pressure differential between the lines 48*a,b*.

In one example, the well tool 32 is selected for actuation by flowing current between the conductors 52*a,b* in a first direction 54*a* (in which case the chambers 44, 46 are connected to the lines 48*a,b*), but the well tool 32 is not selected for actuation when current flows between the conductors 52*a,b* in a second, opposite, direction 54*b* (in which case the chambers 44, 46 are isolated from the lines 48*a,b*). Various configurations of the control device 50 are described below for accomplishing this result. These control device 50 configurations are advantageous in that they do not require complex, sensitive or unreliable electronics or mechanisms, but are instead relatively simple, economical and reliable in operation.

The well tool 32 may be used in place of any or all of the flow control devices 22*a-e* and actuators 24*a-e* in the system 10 of FIG. 1. Suitably configured, the principles of this disclosure could also be used to control actuation of other well tools, such as selective setting of the packers 18*a-e*, etc.

Note that the hydraulic lines 48*a,b* are representative of one type of fluid pressure source 48 which may be used in keeping with the principles of this disclosure. It should be understood that other fluid pressure sources (such as pressure within the tubing string 20, pressure in an annulus 56 between the tubing and casing strings 20, 16, pressure in an atmospheric or otherwise pressurized chamber, etc., may be used as fluid pressure sources in conjunction with the control device 50 for supplying pressure to the actuator 36 in other embodiments.

The conductors 52*a,b* comprise a set of conductors 52 through which current flows, and this current flow is used by the control device 50 to determine whether the associated well tool 32 is selected for actuation. Two conductors 52*a,b* are depicted in FIG. 2 as being in the set of conductors 52, but it should be understood that any number of conductors may be used in keeping with the principles of this disclosure. In addition, the conductors 52*a,b* can be in a variety of forms, such as wires, metal structures (for example, the casing or tubing strings 16, 20, etc.), or other types of conductors.

The conductors 52*a,b* preferably extend to a remote location (such as the earth's surface, a subsea wellhead, another location in the well, etc.). For example, a surface power supply and multiplexing controller can be connected to the conductors 52*a,b* for flowing current in either direction 54*a,b* between the conductors.

In the examples described below, n conductors can be used to selectively control actuation of n*(n−1) well tools. The benefits of this arrangement quickly escalate as the number of well tools increases. For example, three conductors may be used to selectively actuate six well tools, and only one additional conductor is needed to selectively actuate twelve well tools.

Figure 3:
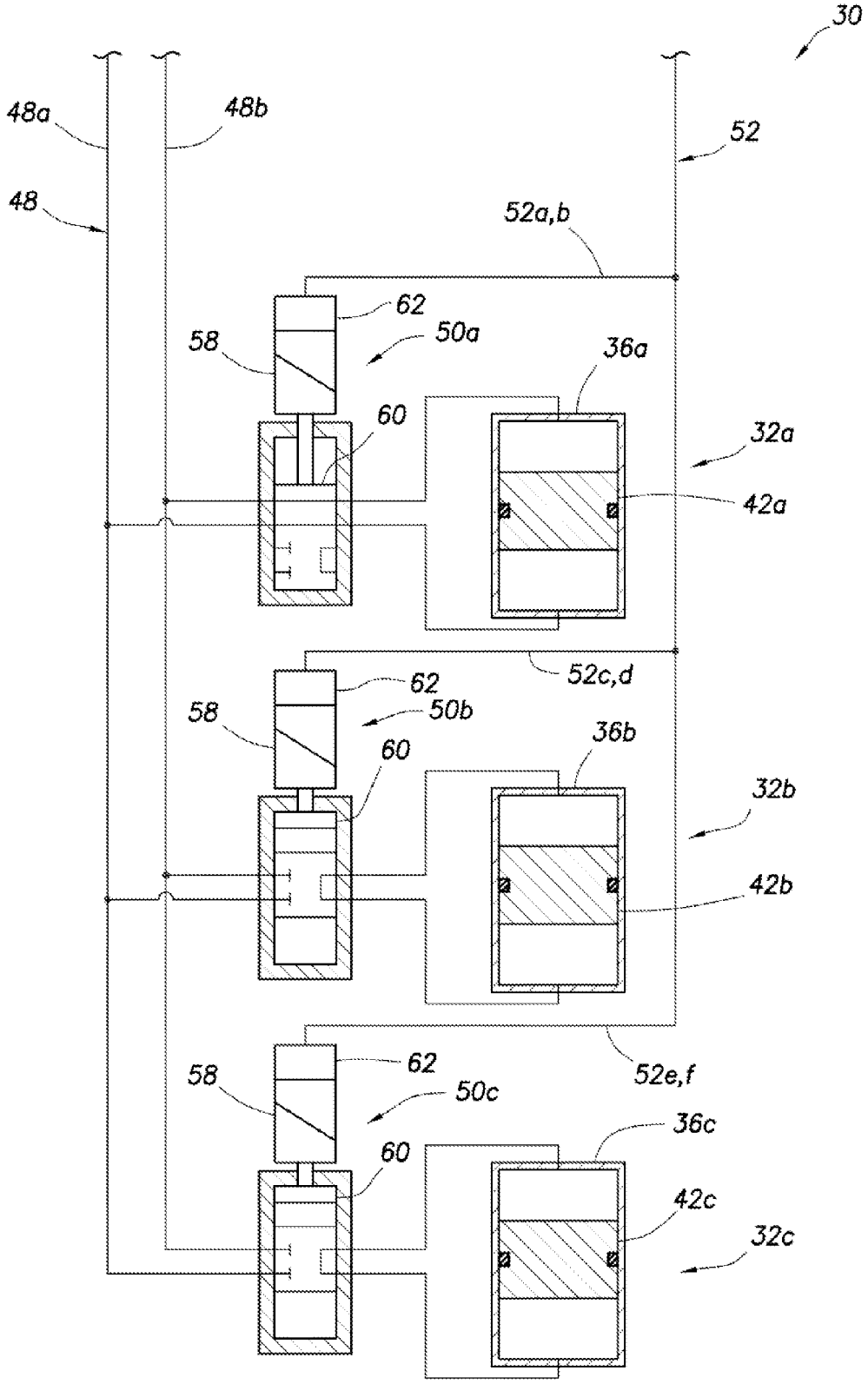
FIG. 3 is a schematic electrical and hydraulic diagram showing a system and method for remotely actuating multiple downhole well tools.

Referring additionally now to FIG. 3, a somewhat more detailed illustration of the electrical and hydraulic aspects of one example of the system 30 are provided. In addition, FIG. 3 provides for additional explanation of how multiple well tools 32 may be selectively actuated using the principles of this disclosure.

In this example, multiple control devices 50*a-c* are associated with respective multiple actuators 36*a-c* of multiple well tools 32*a-c*. It should be understood that any number of control devices, actuators and well tools may be used in keeping with the principles of this disclosure, and that these elements may be combined, if desired (for example, multiple control devices could be combined into a single device, a single well tool can include multiple functional well tools, an actuator and/or control device could be built into a well tool, etc.).

Each of the control devices 50*a-c* depicted in FIG. 3 includes a solenoid actuated spool valve. A solenoid 58 of the control device 50*a* has displaced a spool or poppet valve 60 to a position in which the actuator 36*a* is now connected to the lines 48*a,b*. A pressure differential between the lines 48*a,b* can now be used to displace the piston 42*a* and actuate the well tool 32*a*. The remaining control devices 50*b,c* prevent actuation of their associated well tools 32*b,c* by isolating the lines 48*a,b* from the actuators 36*b,c*.

The control device 50*a* responds to current flow through a certain set of the conductors 52. In this example, conductors 52*a,b* are connected to the control device 50*a*. When current flows in one direction through the conductors 52*a,b*, the control device 50*a* causes the actuator 36*a* to be operatively connected to the lines 48*a,b*, but when current flows in an opposite direction through the conductors, the control device causes the actuator to be operatively isolated from the lines.

As depicted in FIG. 3, the other control devices 50*b,c* are connected to different sets of the conductors 52. For example, control device 50*b* is connected to conductors 52*c,d* and control device 50*c* is connected to conductors 52*e,f*.

When current flows in one direction through the conductors 52*c,d*, the control device 50*b* causes the actuator 36*b* to be operatively connected to the lines 48*a,b*, but when current flows in an opposite direction through the conductors, the control device causes the actuator to be operatively isolated from the lines. Similarly, when current flows in one direction through the conductors 52*e,f*, the control device 50*c* causes the actuator 36*c* to be operatively connected to the lines 48*a,b*, but when current flows in an opposite direction through the conductors, the control device causes the actuator to be operatively isolated from the lines.

However, it should be understood that multiple control devices are preferably, but not necessarily, connected to each set of conductors. By connecting multiple control devices to the same set of conductors, the advantages of a reduced number of conductors can be obtained, as explained more fully below.

The function of selecting a particular well tool 32*a-c* for actuation in response to current flow in a particular direction between certain conductors is provided by directional elements 62 of the control devices 50*a-c*. Various different types of directional elements 62 are described more fully below.

Figure 4:
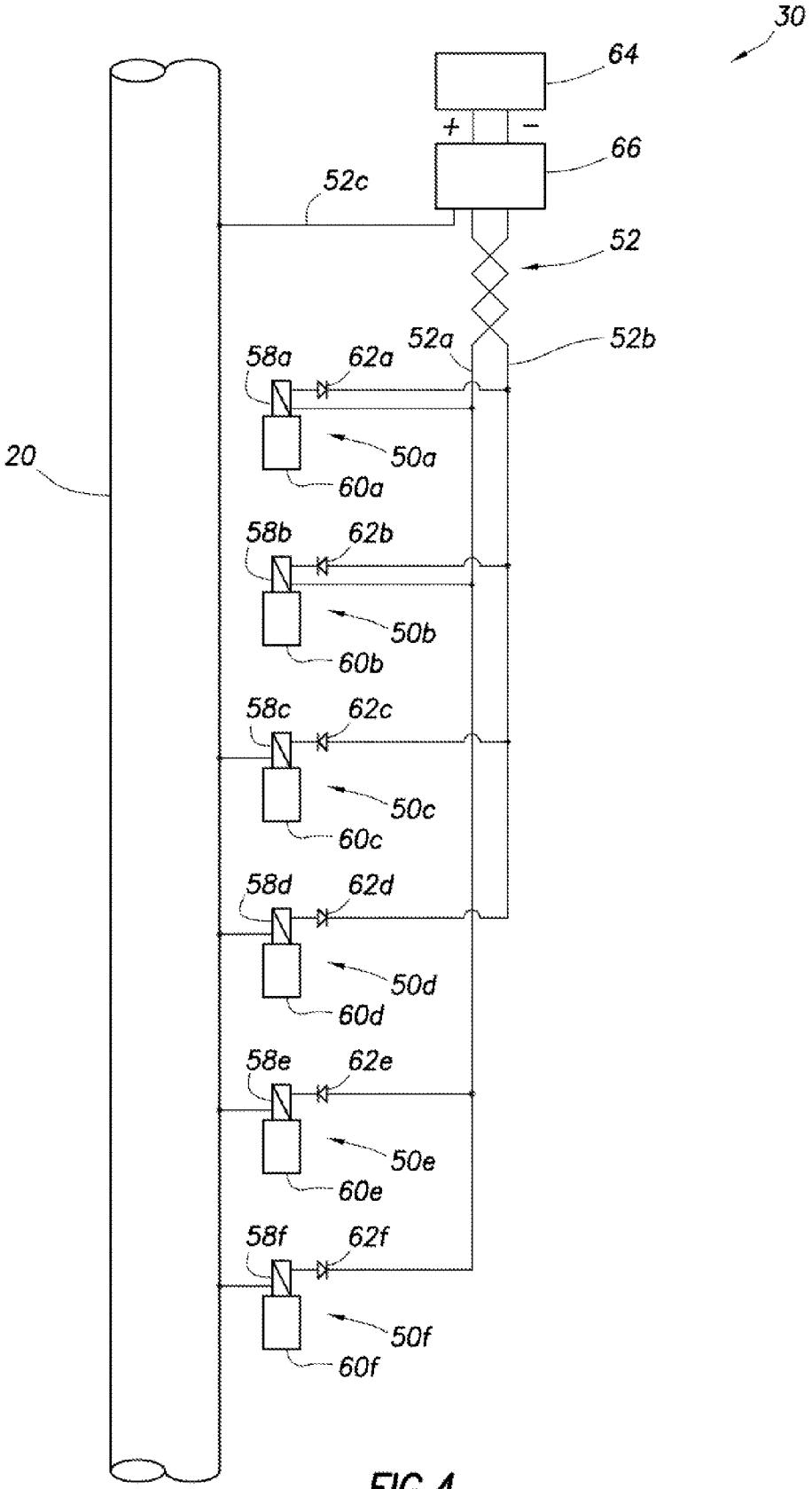
FIG. 4 is a schematic electrical diagram showing another configuration of the system and method for remotely actuating multiple downhole well tools.

Referring additionally now to FIG. 4, an example of the system 30 is representatively illustrated, in which multiple control devices are connected to each of multiple sets of conductors, thereby achieving the desired benefit of a reduced number of conductors in the well. In this example, actuation of six well tools may be selectively controlled using only three conductors, but, as described herein, any number of conductors and well tools may be used in keeping with the principles of this disclosure.

As depicted in FIG. 4, six control devices 50*a-f* are illustrated apart from their respective well tools. However, it will be appreciated that each of these control devices 50*a-f* would in practice be connected between the fluid pressure source 48 and a respective actuator 36 of a respective well tool 32 (for example, as described above and depicted in FIGS. 2 & 3).

The control devices 50*a-f* include respective solenoids 58*a-f*, spool valves 60*a-f* and directional elements 62*a-f*. In this example, the elements 62*a-f* are diodes. Although the solenoids 58*a-f* and diodes 62*a-f* are electrical components, they do not comprise complex or unreliable electronic circuitry, and suitable reliable high temperature solenoids and diodes are readily available.

A power supply 64 is used as a source of direct current. The power supply 64 could also be a source of alternating current and/or command and control signals, if desired. However, the system 30 as depicted in FIG. 4 relies on directional control of current in the conductors 52 in order to selectively actuate the well tools 32, so alternating current, signals, etc. should be present on the conductors only if such would not interfere with this selection function. If the casing string 16 and/or tubing string 20 is used as a conductor in the system 30, then preferably the power supply 64 comprises a floating power supply.

The conductors 52 may also be used for telemetry, for example, to transmit and receive data and commands between the surface and downhole well tools, actuators, sensors, etc. This telemetry can be conveniently transmitted on the same conductors 52 as the electrical power supplied by the power supply 64.

The conductors 52 in this example comprise three conductors 52*a-c*. The conductors 52 are also arranged as three sets of conductors 52*a,b* 52*b,c* and 52*a,c*. Each set of conductors includes two conductors. Note that a set of conductors can share one or more individual conductors with another set of conductors.

Each conductor set is connected to two control devices. Thus, conductor set 52*a,b* is connected to each of control devices 50*a,b*, conductor set 52*b,c* is connected to each of control devices 50*c,d*, and conductor set 52*a,c* is connected to each of control devices 50*e,f*.

In this example, the tubing string 20 is part of the conductor 52*c*. Alternatively, or in addition, the casing string 16 or any other conductor can be used in keeping with the principles of this disclosure.

It will be appreciated from a careful consideration of the system 30 as depicted in FIG. 4 (including an observation of how the diodes 62*a-f* are arranged between the solenoids 58*a-f* and the conductors 52*a-c*) that different current flow directions between different conductors in the different sets of conductors can be used to select which of the solenoids 58*a-f* are powered to thereby actuate a respective well tool. For example, current flow from conductor 52*a* to conductor 52*b* will provide electrical power to solenoid 58*a* via diode 62*a*, but oppositely directed current flow from conductor 52*b* to conductor 52*a* will provide electrical power to solenoid 58*b* via diode 62*b*. Conversely, diode 62*a* will prevent solenoid 58*a* from being powered due to current flow from conductor 52*b* to conductor 52*a*, and diode 62*b* will prevent solenoid 58*b* from being powered due to current flow from conductor 52*a* to conductor 52*b*.

Similarly, current flow from conductor 52*b* to conductor 52*c* will provide electrical power to solenoid 58*c* via diode 62*c*, but oppositely directed current flow from conductor 52*c* to conductor 52*b* will provide electrical power to solenoid 58*d* via diode 62*d*. Diode 62*c* will prevent solenoid 58*c* from being powered due to current flow from conductor 52*c* to conductor 52*b*, and diode 62*d* will prevent solenoid 58*d* from being powered due to current flow from conductor 52*b* to conductor 52*c*.

Current flow from conductor 52*a* to conductor 52*c* will provide electrical power to solenoid 58*e* via diode 62*e*, but oppositely directed current flow from conductor 52*c* to conductor 52*a* will provide electrical power to solenoid 58*f* via diode 62*f*. Diode 62*e* will prevent solenoid 58*e* from being powered due to current flow from conductor 52*c* to conductor 52*a*, and diode 62*f* will prevent solenoid 58*f* from being powered due to current flow from conductor 52*a* to conductor 52*c*.

The direction of current flow between the conductors 52 is controlled by means of a switching device 66. The switching device 66 is interconnected between the power supply 64 and the conductors 52, but the power supply and switching device could be combined, or could be part of an overall control system, if desired.

Figure 5:
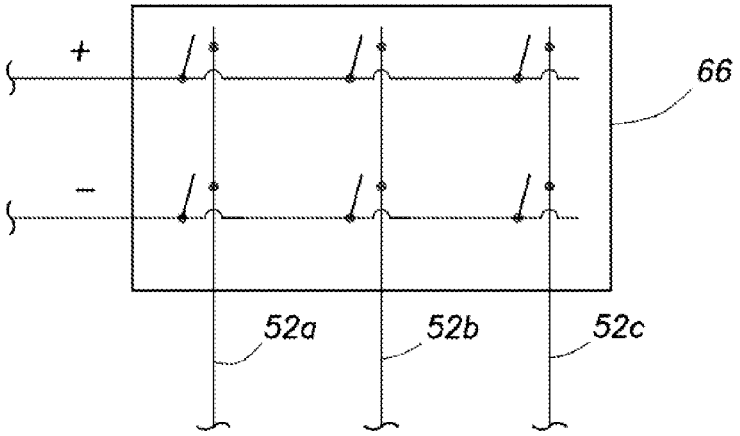
FIG. 5 is a schematic electrical diagram showing details of a switching arrangement which may be used in the system of FIG. 4.
Figure 6:
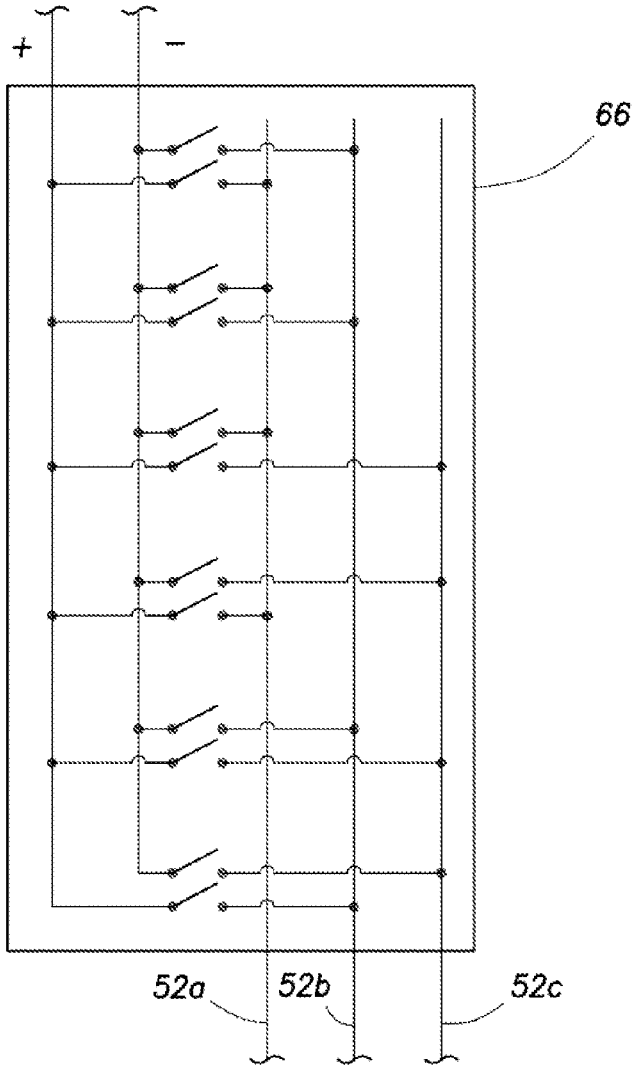
FIG. 6 is a schematic electrical diagram showing details of another switching arrangement which may be used in the system of FIG. 4.

Examples of different configurations of the switching device 66 are representatively illustrated in FIGS. 5 & 6. FIG. 5 depicts an embodiment in which six independently controlled switches are used to connect the conductors 52*a-c* to the two polarities of the power supply 64. FIG. 6 depicts an embodiment in which an appropriate combination of switches are closed to select a corresponding one of the well tools for actuation. This embodiment might be implemented, for example, using a rotary switch. Other implementations (such as using a programmable logic controller, etc.) may be utilized as desired.

Figure 7:
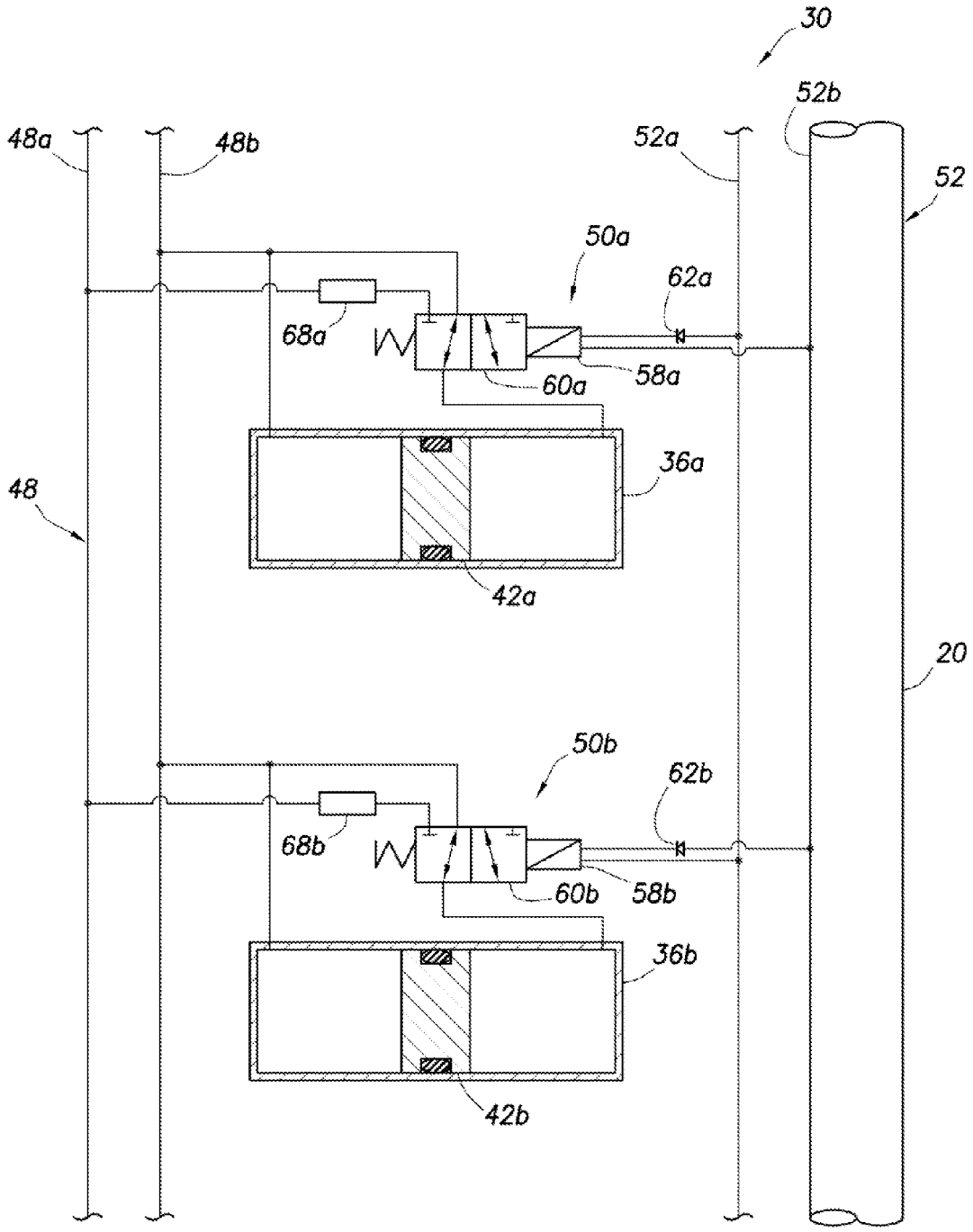
FIG. 7 is a schematic electrical and hydraulic diagram showing another configuration of the system and method for remotely actuating multiple downhole well tools.

Referring additionally now to FIG. 7, another configuration of the control system 30 is representatively illustrated. The configuration of FIG. 7 is similar in many respects to the configuration of FIG. 3. However, only two each of the actuators 36*a,b* and control devices 50*a,b*, and one set of conductors 52*a,b* are depicted in FIG. 7, it being understood that any number of actuators, control devices and sets of conductors may be used in keeping with the principles of this disclosure.

Another difference between the FIGS. 3 & 7 configurations is in the spool valves 60*a,b*. The spool valves 60 in the FIGS. 3 & 7 configurations accomplish similar results, but in somewhat different manners. In both configurations, the spool valves 60 pressure balance the pistons 42 when the solenoids 58 are not powered, and they connect the actuators 36 to the pressure source 48 when the solenoids 58 are powered. However, in the FIG. 3 configuration, the actuators 36 are completely isolated from the pressure source 48 when the solenoids 58 are not powered, whereas in the FIG. 7 configuration, the actuators remain connected to one of the lines 48*b* when the solenoids are not powered.

Another difference is that pressure-compensated flow rate regulators 68*a,b* are connected between the line 48*a* and respective spool valves 60*a,b*. The flow regulators 68*a,b* maintain a substantially constant flow rate therethrough, even though pressure differential across the flow regulators may vary. A suitable flow regulator for use in the system 30 is a FLOSERT™ available from Lee Co. of Essex, Conn. USA.

When one of the solenoids 58*a,b* is powered and the respective piston 42*a* or *b* is being displaced in response to a pressure differential between the lines 48*a,b*, the flow regulator 68*a* or *b* will ensure that the piston displaces at a predetermined velocity, since fluid will flow through the flow regulator at a corresponding predetermined flow rate. In this manner, the position of the piston can be precisely controlled (i.e., by permitting the piston to displace at its predetermined velocity for a given amount of time, which can be precisely controlled via the control device due to the presence and direction of current flow in the conductors 52 as described above).

Although the flow regulators 68*a,b* are depicted in FIG. 7 as being connected between the line 48*a* and the respective spool valves 60*a,b*, it will be appreciated that other arrangements are possible. For example, the flow regulators 68*a,b* could be connected between the line 48*b* and the spool valves 60*a,b*, or between the spool valves and the actuators 36*a,b*, etc.

In addition, the flow regulators may be used in any of the other control system 30 configurations described herein, if desired, in order to allow for precise control of the positions of the pistons in the actuators. Such positional control is very useful in flow choking applications, for example, to precisely regulate production or injection flow between multiple zones and a tubing string.

Note that, in the example of FIG. 7, the conductor 52*b* includes the tubing string 20. This demonstrates that any of the conductors 52 can comprise a tubular string in the well.

Figure 8:
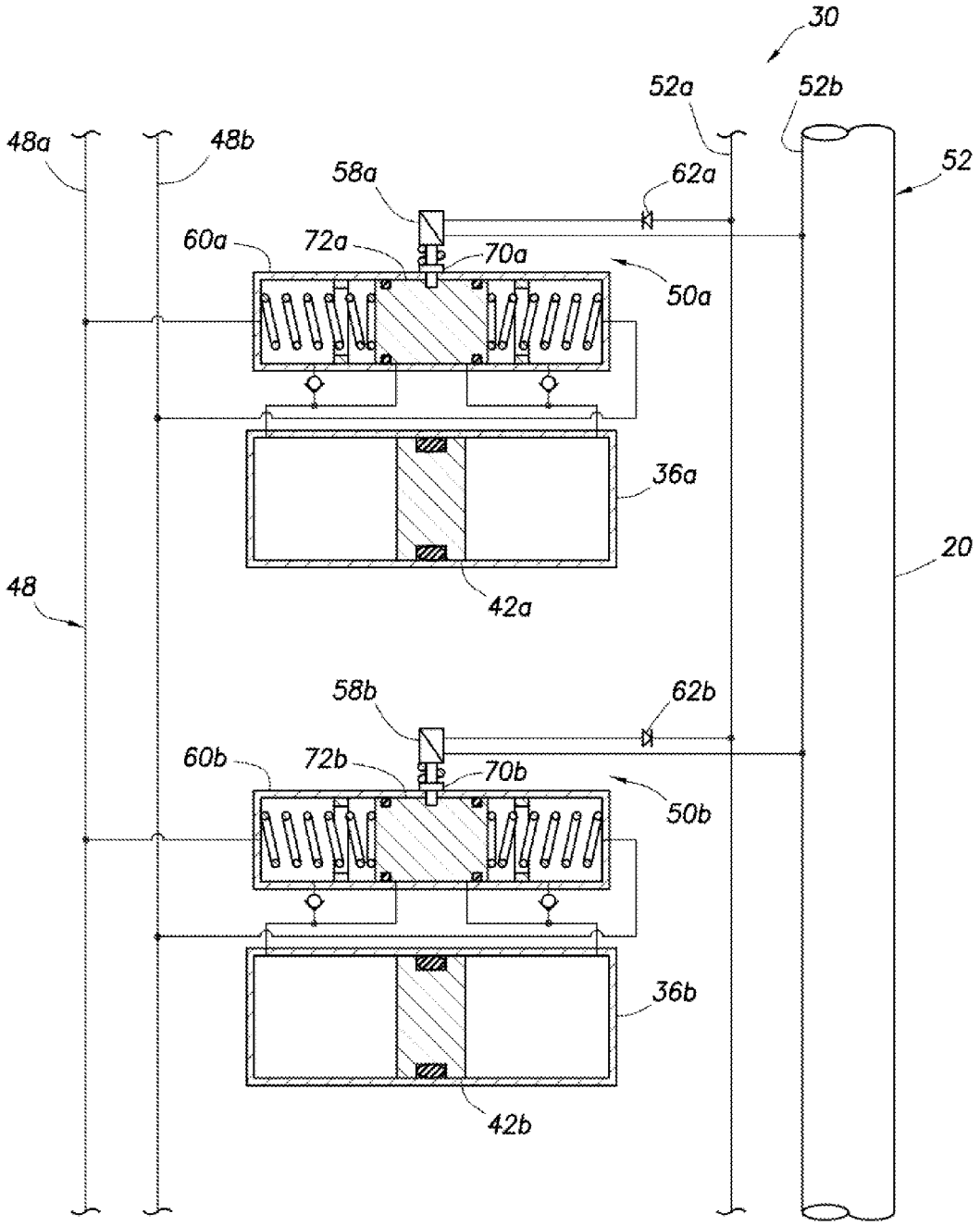
FIG. 8 is a schematic electrical and hydraulic diagram showing another configuration of the system and method for remotely actuating multiple downhole well tools.

Referring additionally now to FIG. 8, another configuration of the control system 30 is representatively illustrated. The configuration of FIG. 8 is similar in many respects to the configuration of FIG. 7, but differs substantially in the manner in which the control devices 50*a,b* operate.

Specifically, the spool valves 60*a,b* are pilot-operated, with the solenoids 58*a,b* serving to selectively permit or prevent such pilot operation. Thus, powering of a respective one of the solenoids 58*a,b* still operates to select a particular one of the well tools 32 for actuation, but the amount of power required to do so is expected to be much less in the FIG. 8 embodiment.

For example, if the solenoid 58*a* is powered by current flow from conductor 52*a* to conductor 52*b*, the solenoid will cause a locking member 70*a* to retract out of locking engagement with a piston 72*a* of the spool valve 60*a*. The piston 72*a* will then be free to displace in response to a pressure differential between the lines 48*a,b*. If, for example, pressure in the line 48*a* is greater than pressure in the line 48*b*, the piston 72*a* will displace to the right as viewed in FIG. 8, thereby connecting the actuator 36*a* to the pressure source 48, and the piston 42*a* of the actuator 36*a* will displace to the right. However, when the piston 72*a* is in its centered and locked position, the actuator 36*a* is pressure balanced.

Similarly, if the solenoid 58*b* is powered by current flow from conductor 52*b* to conductor 52*a*, the solenoid will cause a locking member 70*b* to retract out of locking engagement with a piston 72*b* of the spool valve 60*b*. The piston 72*b* will then be free to displace in response to a pressure differential between the lines 48*a,b*. If, for example, pressure in the line 48*b* is greater than pressure in the line 48*a*, the piston 72*b* will displace to the left as viewed in FIG. 8, thereby connecting the actuator 36*b* to the pressure source 48, and the piston 42*b* of the actuator 36*b* will displace to the left. However, when the piston 72*b* is in its centered and locked position, the actuator 36*b* is pressure balanced.

The locking engagement between the locking members 70*a,b* and the pistons 72*a,b* could be designed to release in response to a predetermined pressure differential between the lines 48*a,b* (preferably, a pressure differential greater than that expected to be used in normal operation of the system 30). In this manner, the actuators 36*a,b* could be operated by applying the predetermined pressure differential between the lines 48*a,b*, for example, in the event that one or both of the solenoids 58*a,b* failed to operate, in an emergency to quickly close the flow control devices 38, etc.

Figure 9:
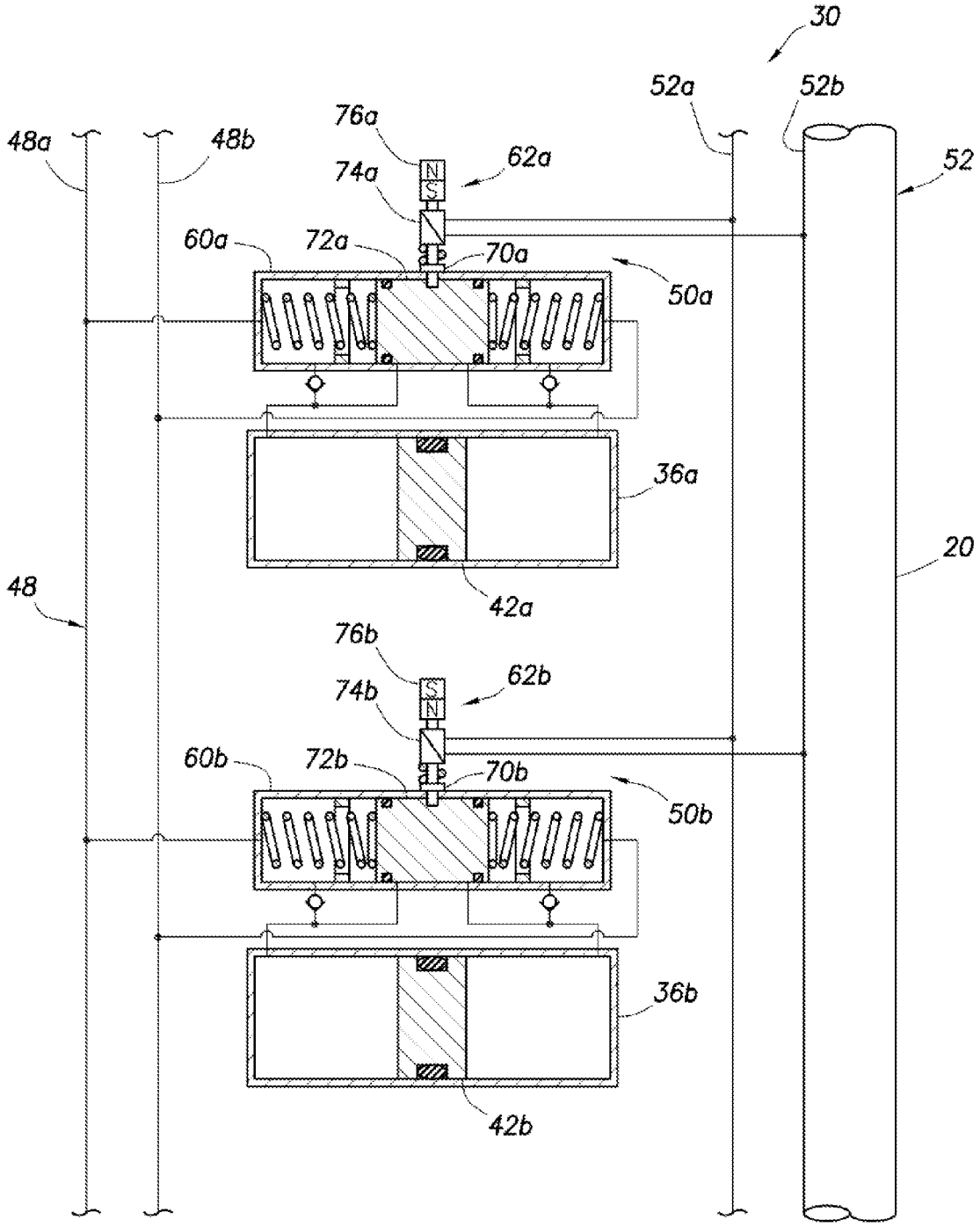
FIG. 9 is a schematic electrical and hydraulic diagram showing another configuration of the system and method for remotely actuating multiple downhole well tools.

Referring additionally now to FIG. 9, another configuration of the control system 30 is representatively illustrated. The FIG. 9 configuration is similar in many respects to the FIG. 8 configuration, except that the solenoids and diodes are replaced by coils 74*a,b* and magnets 76*a,b* in the control devices 50*a,b* of FIG. 9.

The coils 74*a,b* and magnets 76*a,b* also comprise the directional elements 62*a,b* in the control devices 50*a,b* since the respective locking members 70*a,b* will only displace if current flows between the conductors 52*a,b* in appropriate directions. For example, the coil 74*a* and magnet 76*a* are arranged so that, if current flows from conductor 52*a* to conductor 52*b*, the coil will generate a magnetic field which opposes the magnetic field of the magnet, and the locking member 70*a* will thus be displaced upward (as viewed in FIG. 9) out of locking engagement with the piston 72*a*, and the actuator 36*a* can be connected to the pressure source 48 as described above. Current flow in the opposite direction will not cause such displacement of the locking member 70*a*.

Similarly, the coil 74*b* and magnet 76*b* are arranged so that, if current flows from conductor 52*b* to conductor 52*a*, the coil will generate a magnetic field which opposes the magnetic field of the magnet, and the locking member 70*b* will thus be displaced upward (as viewed in FIG. 9) out of locking engagement with the piston 72*b*, and the actuator 36*b* can be connected to the pressure source 48 as described above. Current flow in the opposite direction will not cause such displacement of the locking member 70*b*.

It will, thus, be appreciated that the FIG. 9 configuration obtains all of the benefits of the previously described configurations, but does not require use of any downhole electrical components, other than the coils 74*a,b* and conductors 52.

Figure 10:
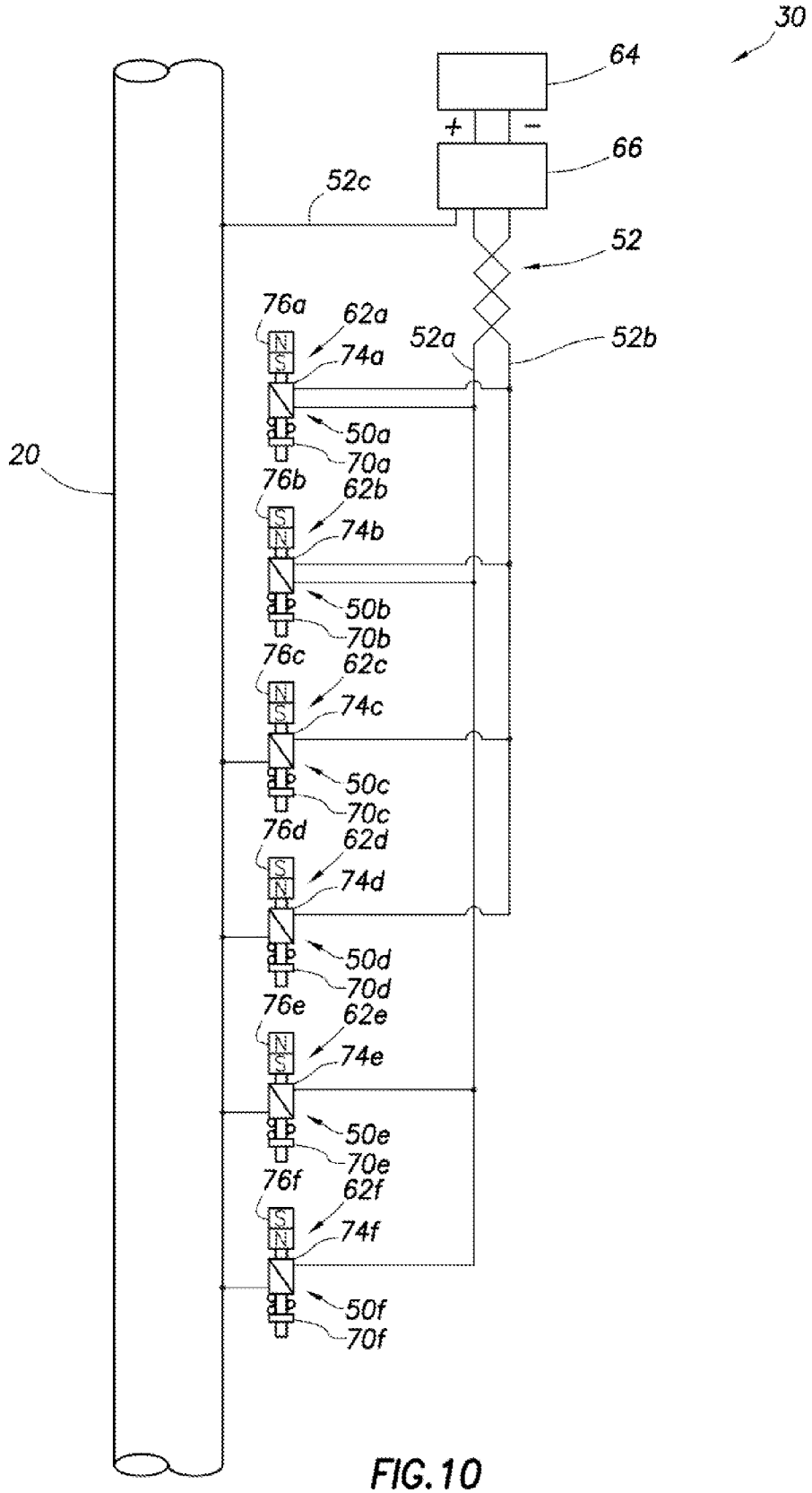
FIG. 10 is a schematic electrical diagram showing another configuration of the system and method for remotely actuating multiple downhole well tools.

Referring additionally now to FIG. 10, another configuration of the control system 30 is representatively illustrated. The FIG. 10 configuration is similar in many respects to the FIG. 9 configuration, but is depicted with six of the control devices 50*a-f* and three sets of the conductors 52, similar to the system 30 as illustrated in FIG. 4. The spool valves 60, actuators 36 and well tools 32 are not shown in FIG. 10 for clarity of illustration and description.

In this FIG. 10 configuration, the coils 74*a-f* and magnets 76*a-f* are arranged so that selected locking members 70*a-f* are displaced in response to current flow in particular directions between certain conductors in the sets of the conductors 52. For example, current flow between the conductors 52*a,b* in one direction may cause the element 62*a* to displace the locking member 70*a* while current flow between the conductors 52*a,b* in an opposite direction may cause the element 62*b* to displace the locking member 70*b*, current flow between the conductors 52*b,c* may cause the element 62*c* to displace the locking member 70*c* while current flow between the conductors 52*b,c* may cause the element 62*d* to displace the locking member 70*d*, and current flow between the conductors 52*a,c* may cause the element 62*e* to displace the locking member 70*e* while current flow between the conductors 52*a,c* in an opposite direction may cause the element 62*f* to displace the locking member 70*f*.

Note that, in each pair of the control devices 50*a,b* 50*c,d* and 50*e,f* connected to the respective sets 52*a,b* 52*b,c* and 52*a,c* of conductors, the magnets 76*a,b* 70*c,d* and 70*e,f* are oppositely oriented (i.e., with their poles facing opposite directions in each pair of control devices). This alternating orientation of the magnets 76*a-f*, combined with the connection of the coils 74*a-f* to particular sets of the conductors 52, results in the capability of selecting a particular well tool 32 for actuation by merely flowing current in a particular direction between particular ones of the conductors.

Figure 11:
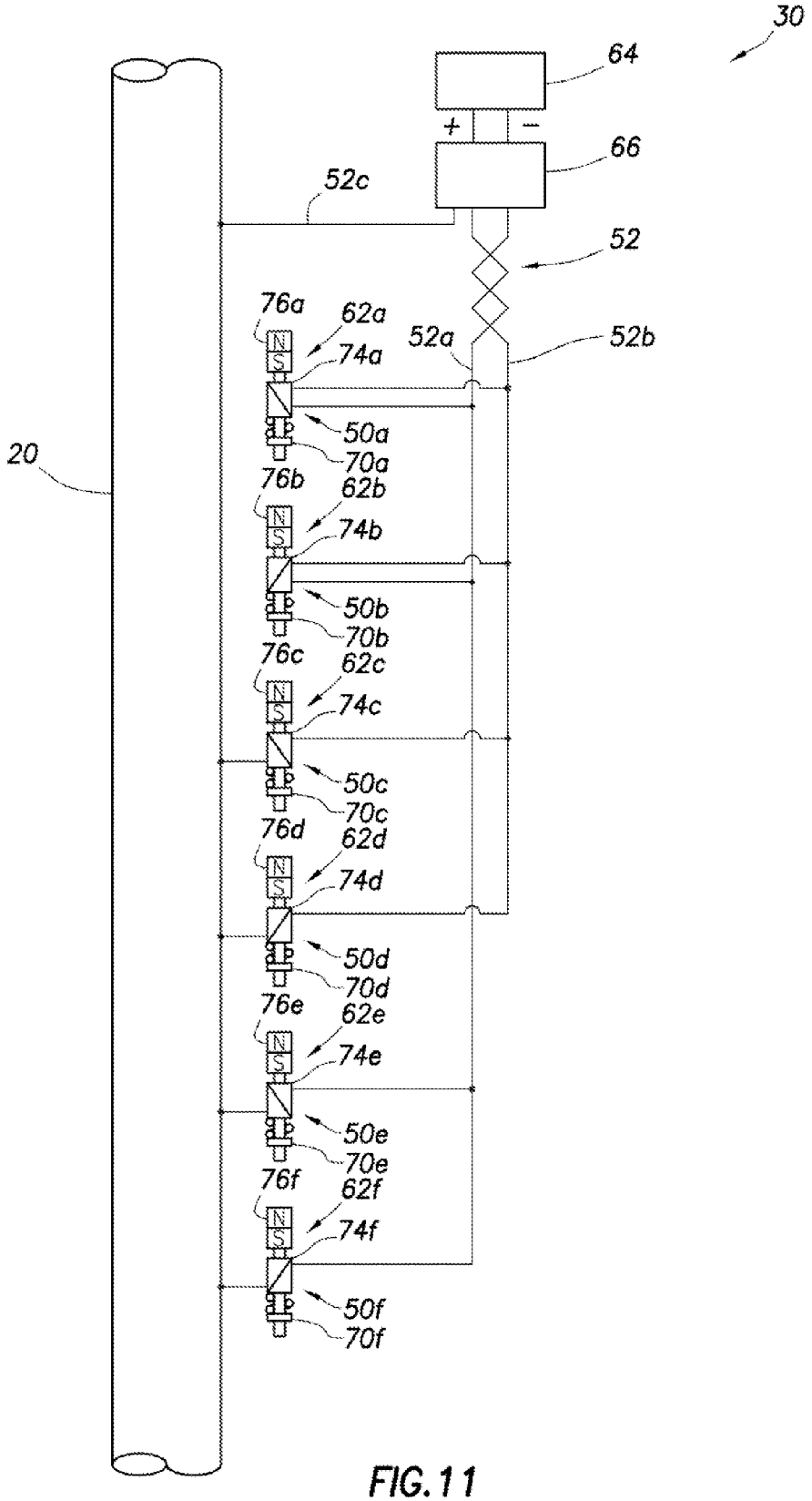
FIG. 11 is a schematic electrical diagram showing another configuration of the system and method for remotely actuating multiple downhole well tools.

Another manner of achieving this result is representatively illustrated in FIG. 11. Instead of alternating the orientation of the magnets 76*a-f* as in the FIG. 10 configuration, the coils 74*a-f* are oppositely arranged in the pairs of control devices 50*a,b* 50*c,d* and 50*e,f*. For example, the coils 74*a-f* could be wound in opposite directions, so that opposite magnetic field orientations are produced when current flows between the sets of conductors.

Another manner of achieving this result would be to oppositely connect the coils 74*a-f* to the respective conductors 52. In this configuration, current flow between a set of conductors would produce a magnetic field in one orientation from one of the coils, but a magnetic field in an opposite orientation from the other one of the coils.

Note that multiple well tools 32 may be selected for actuation at the same time. For example, multiple similarly configured control devices 50 could be wired in series or parallel to the same set of the conductors 52, or control devices connected to different sets of conductors could be operated at the same time by flowing current in appropriate directions through the sets of conductors.

In addition, note that fluid pressure to actuate the well tools 32 may be supplied by one of the lines 48, and another one of the lines (or another flow path, such as an interior of the tubing string 20 or the annulus 56) may be used to exhaust fluid from the actuators 36. An appropriately configured and connected spool valve can be used, so that the same one of the lines 48 can be used to supply fluid pressure to displace the pistons 42 of the actuators 36 in each direction.

Preferably, in each of the above-described embodiments, the fluid pressure source 48 is pressurized prior to flowing current through the selected set of conductors 52 to actuate a well tool 32. In this manner, actuation of the well tool 32 immediately follows the initiation of current flow in the set of conductors 52.

Figure 12:
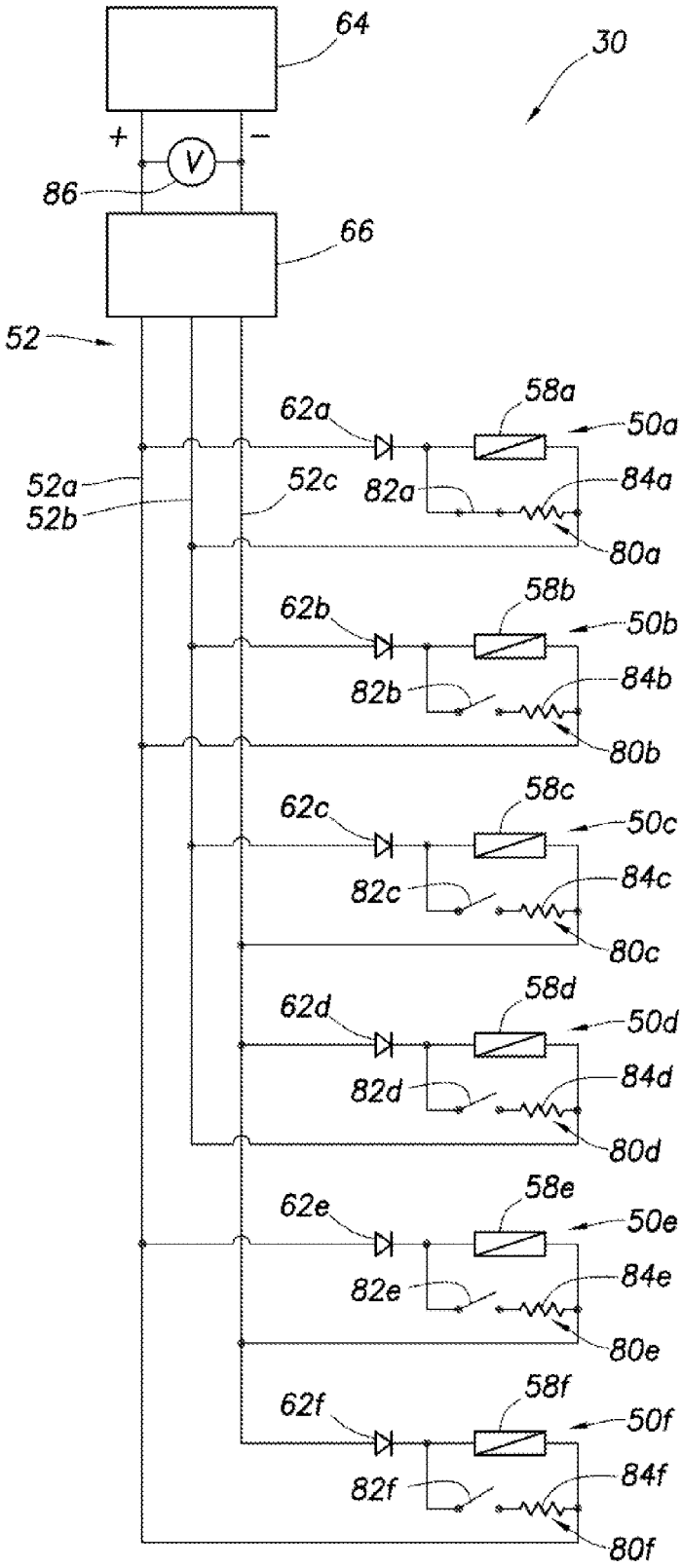
FIG. 12 is a schematic electrical diagram showing another configuration of the system and method, wherein a position indicator is incorporated into each control device for the well tools.

Referring additionally now to FIG. 12, another configuration of the system 30 is representatively illustrated. The configuration of FIG. 12 is similar in many respects to the configuration of FIG. 4, however, the tubing string 20 is not depicted in FIG. 12 as being one of the conductors 52, and the shuttle valves 60 are not depicted in FIG. 12. Nevertheless, it will be understood that if current flows through a selected one of the solenoids 58*a-f*, then the respective well tool 32 will be actuated, as described above.

Another difference in the FIG. 12 configuration is that a position indicator 80 is interconnected in parallel with each of the solenoids 58*a-f*. Note that the position indicator 80 could be interconnected in parallel with the coils 74 in the configurations of FIGS. 9-11, or in parallel with any other resistance in the control devices 50.

In the example of FIG. 12, each of the position indicators 80*a-f* includes a switch 82 and a resistor 84. Each of the resistors 84*a-f* preferably has a resistance substantially greater than that of the respective solenoid 58*a-f*, and a voltage drop will be detected (for example, by a voltmeter 86 connected across the constant current power supply 64) when the respective switch 82*a-f* is closed.

The switches 82*a-f* can be closed when the sleeve 34 of the respective well tool 32 displaces to a certain position. Thus, as depicted in FIG. 12, when the switching device 66 connects the power supply 64 to the conductors 52*a,b* so that current flows from conductor 52*a* to conductor 52*b* through the solenoid 58*a*, a certain voltage will be measured at the voltmeter 86, and when the sleeve 34 of the well tool 32 connected to the control device 50*a* displaces to a certain position (e.g., a closed position, an open position, an intermediate position, etc.), a voltage drop will be detected at the voltmeter.

Of course, the position indicator 80*a* could operate in an opposite manner, if desired. For example, the switch 82 could open (thereby producing a voltage increase) when the sleeve 34 of the well tool 32 displaces to a certain position. However, if the sleeve 34 is to be displaced to a position for a substantial period of time, then preferably a voltage drop occurs when the sleeve is at that position, in order to minimize power consumption in the system 30.

Figure 13:
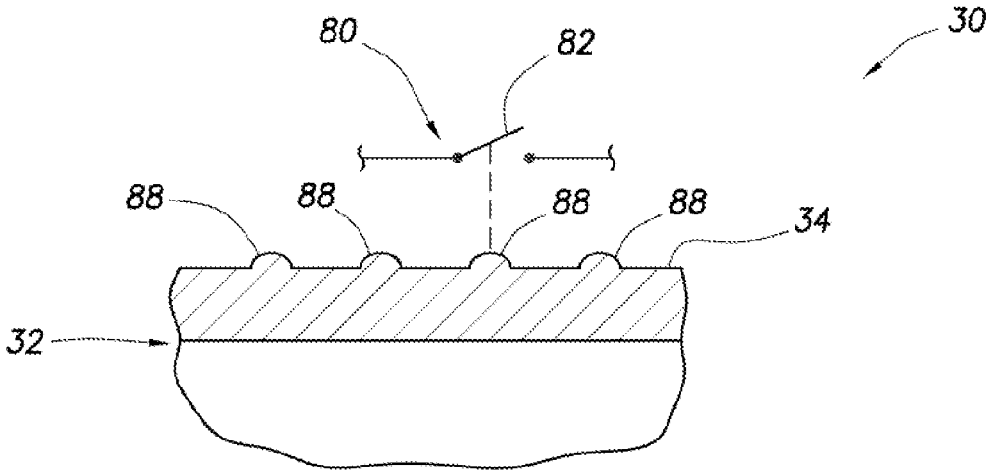
FIG. 13 is a schematic electrical diagram showing another configuration of the position indicator.

Referring additionally now to FIG. 13, a configuration of the position indicator 80 is representatively illustrated apart from the remainder of the system 30. Only the switch 82 of the position indicator 80 is depicted in FIG. 13, along with a portion of the sleeve 34 of the well tool 32, but it will be understood that the switch 82 of FIG. 13 may be used for any of the switches 82*a-f* in the system 30 of FIG. 12.

The switch 82 in FIG. 13 is mechanically actuated in response to displacement of physical irregularities 88 (such as bumps, ridges, grooves, etc.) relative to the switch 82. For example, the switch 82 could be a limit switch or other type of switch which opens or closes in response to displacement of one of the irregularities 88 past the switch.

Each time the switch 82 opens or closes, a voltage change is detected at the voltmeter 86. Since the distance between the irregularities 88 is known, a simple count of the voltage changes will enable the total displacement and position of the sleeve 34 to be determined.

Figure 14:
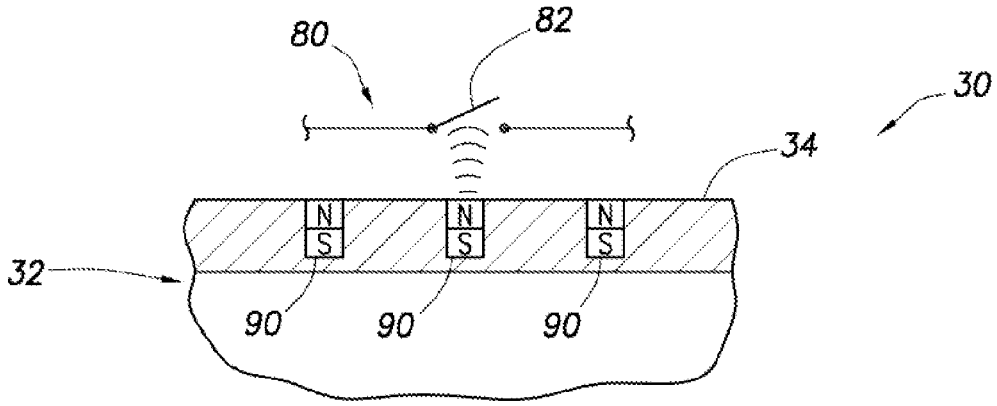
FIG. 14 is a schematic electrical diagram showing another configuration of the position indicator.

Referring additionally now to FIG. 14, a similar configuration of the position indicator 80 is representatively illustrated. However, in the configuration of FIG. 14, the switch 82 is magnetically actuated, for example, by spaced magnets 90 on the sleeve 34.

The switch 82 could be a magnetic reed switch, or any other type of magnetically operated switch. As with the configuration of FIG. 13, each time the switch 82 opens or closes, a voltage change is detected at the voltmeter 86, and a count of the voltage changes will enable the displacement and position of the sleeve 34 to be determined.

Figure 15:
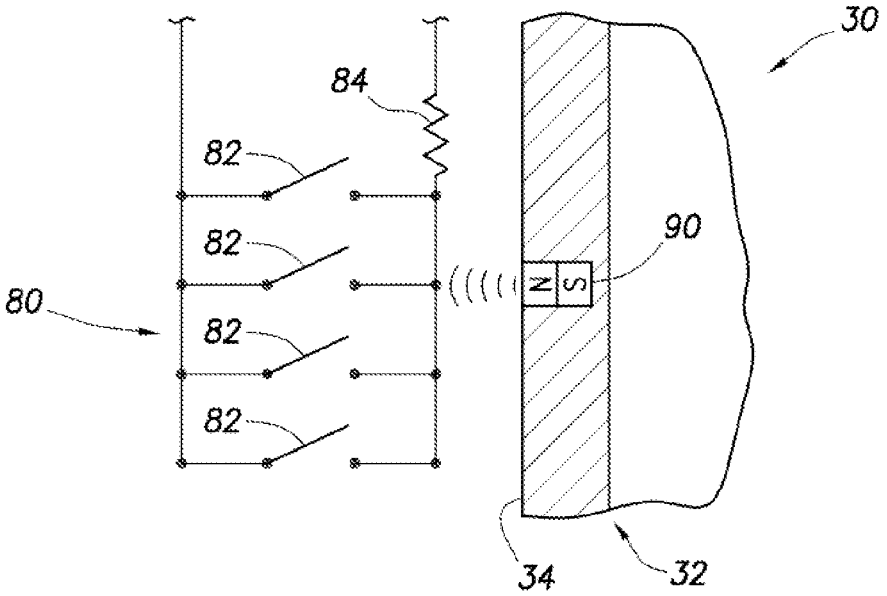
FIG. 15 is a schematic electrical diagram showing another configuration of the position indicator.

Referring additionally now to FIG. 15, another configuration of the position indicator 80 is representatively illustrated. The configuration of FIG. 15 is similar to that of FIG. 14 except that, instead of multiple magnets 90, multiple spaced apart switches 82 are used in each position indicator 80.

As the magnet 90 displaces past each of the switches 82, the switches actuate in turn, and a voltage change is detected at the voltmeter 86. By counting the number of voltage changes, the total displacement and position of the sleeve 34 may be determined.

In the configuration of FIG. 15, the resistor 84 is electrically connected in parallel with the solenoid 58 when each switch 82 is closed. However, in the configuration of FIG. 16, multiple resistors 84 are used, so that the voltage change produced by actuating the switches 82 varies, depending upon which switch is actuated.

That is, a different number of the resistors 84 (and, thus, a different total resistance) is placed in the electrical circuit when each of the switches 82 is actuated. In this manner, the magnitude of the voltage drop produced by actuation of a switch 82 provides an indication of the exact position of the sleeve 34 (since the exact position of each of the switches is known).

Figure 16:
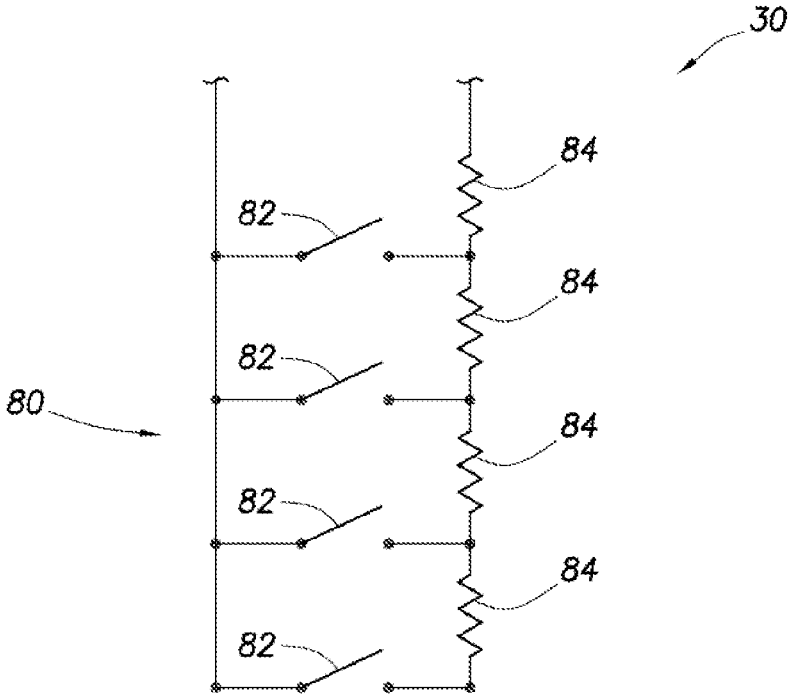
FIG. 16 is a schematic electrical diagram showing another configuration of the position indicator.
Figure 17:
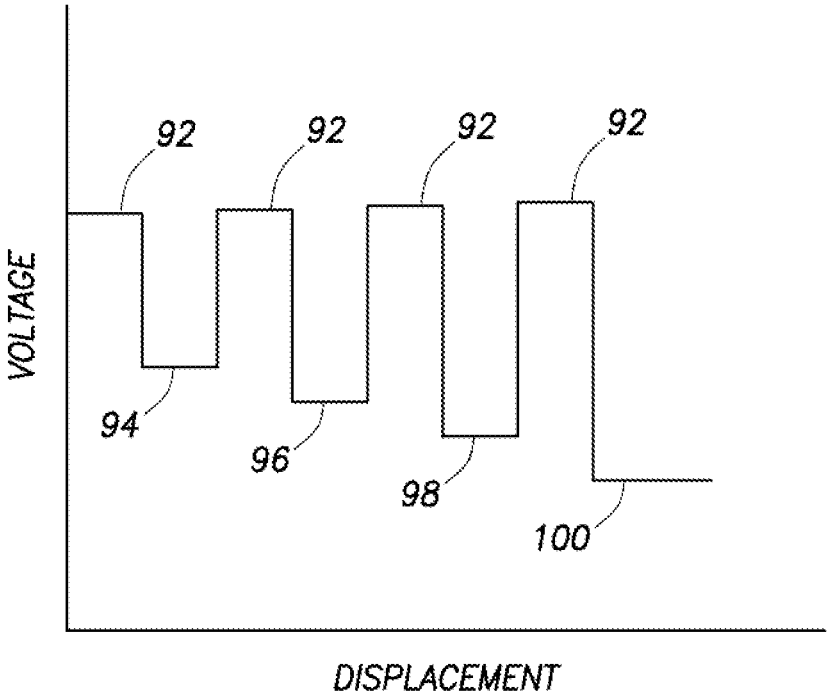
FIG. 17 is a graph of voltage versus displacement for the position indicator of FIG. 16.

In FIG. 17, a graph of voltage versus displacement is provided to illustrate how the configuration of FIG. 16 can be used to determine not only relative displacement, but also exact position. Note that the voltage is at an initial level 92 when none of the switches 82 is closed. However, when one of the switches 82 is closed (such as the lower one of the switches as depicted in FIG. 16), the voltage drops to a reduced level 94.

The voltage returns to the initial level 92 (although this level may change over time, for example, as the solenoid 58 is heated downhole), and then drops to another level 96 when the next switch 82 is closed. The voltage level 96 is lower than the voltage level 94, since fewer of the resistors 84 are in the circuit.

Similarly, voltage levels 98, 100 on the graph correspond to closing of the other two switches 82 in turn. Thus, because each of the voltage levels 94, 96, 98, 100 can be directly associated with closing of a particular one of the switches 82, the exact position of the sleeve 34 when each voltage level occurs can be determined.

Figure 18:
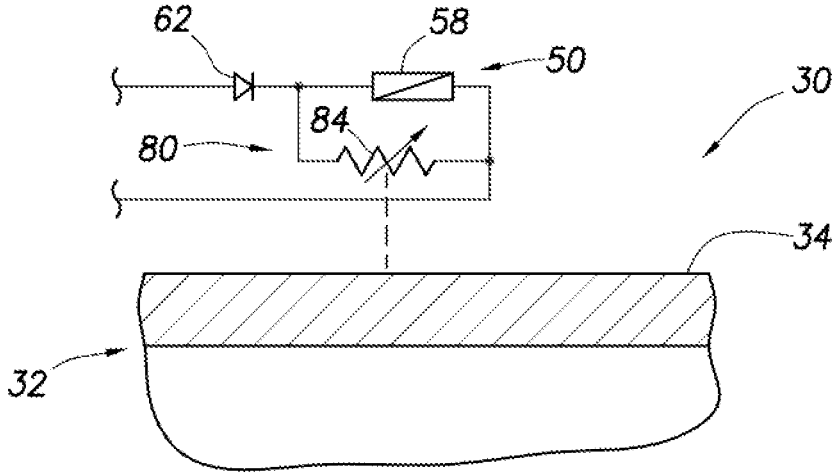
FIG. 18 is a schematic electrical diagram showing another configuration of the position indicator.

Referring additionally now to FIG. 18, another configuration of the position indicator 80 is representatively illustrated. This configuration differs from the other configurations described above, at least in part in that a separate switch 82 is not used and the resistor 84 comprises a variable resistance element.

As the sleeve 34 displaces, the resistor 84 remains in the circuit in parallel with the solenoid 58, but the electrical resistance of the resistor 84 varies depending on the displacement of the sleeve. Thus, by monitoring the voltage across the conductors 52 connected to the control device 50 (with the voltage varying as the resistance across the control devices varies, as described above), the amount of displacement and the position of the sleeve 34 can be readily determined.

Figure 19:
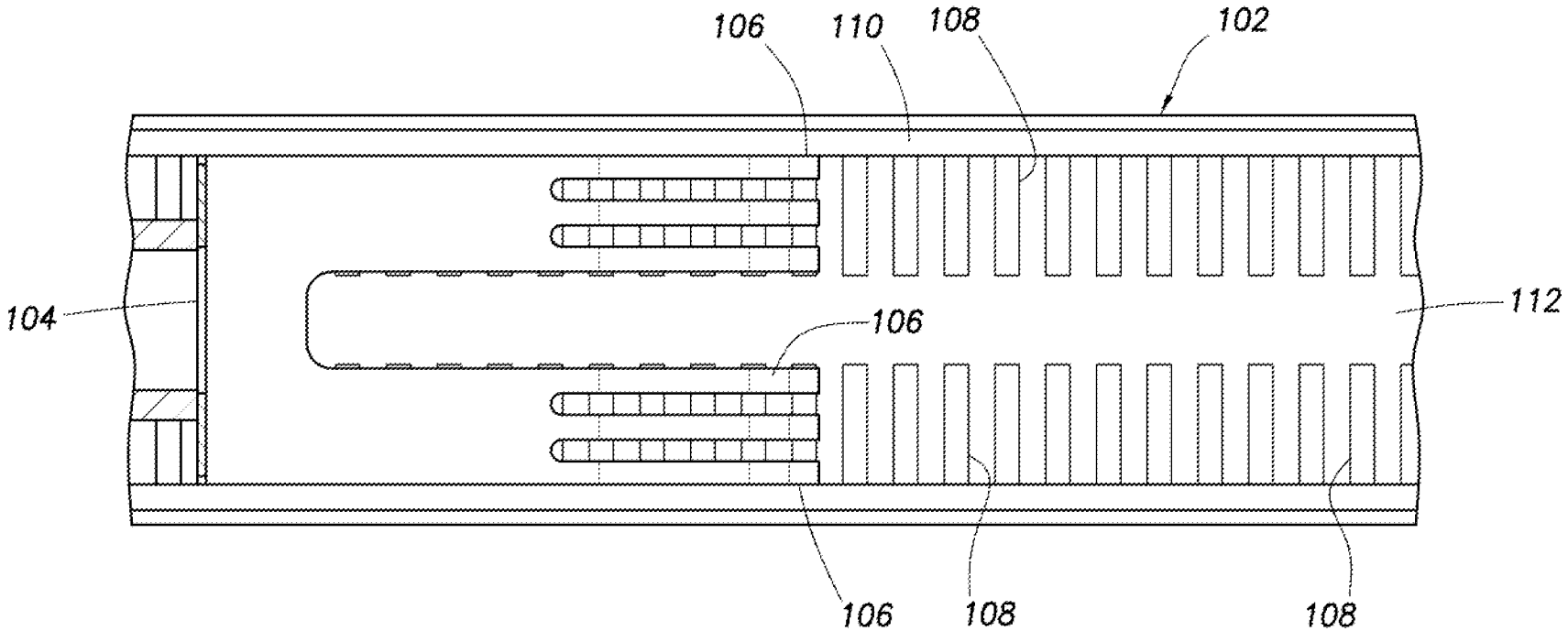
FIG. 19 is a plan view of a resistive element configuration which may be used in the position indicator of FIG. 18.

Representatively illustrated in FIG. 19 is a resistive element 102 which may be used for the variable resistor 84 in the position indicator 80 of FIG. 18. The resistive element 102 is similar to that described in international patent application no. PCT/US07/79945, filed on Sep. 28, 2007 and assigned to the assignee of the present application. Any of the resistive element configurations described in the prior international application may be used for the variable resistor 84 in the position indicator 80 of FIG. 18.

The resistive element 102 includes contacts 104 which are connected to the sleeve 34 for displacement with the sleeve. As the sleeve 34 displaces, contact fingers 106 slide across a series of spaced apart conductive strips 108 formed by layering a conductive material 110 and an insulative material 112.

Thus, while the contact fingers 106 are contacting the conductive strips 108, a relatively low resistance exists across the resistive element 102, and while the contact fingers are contacting the insulative material 112 between the conductive strips, a relatively high resistance exists across the resistive element.

Figure 20:
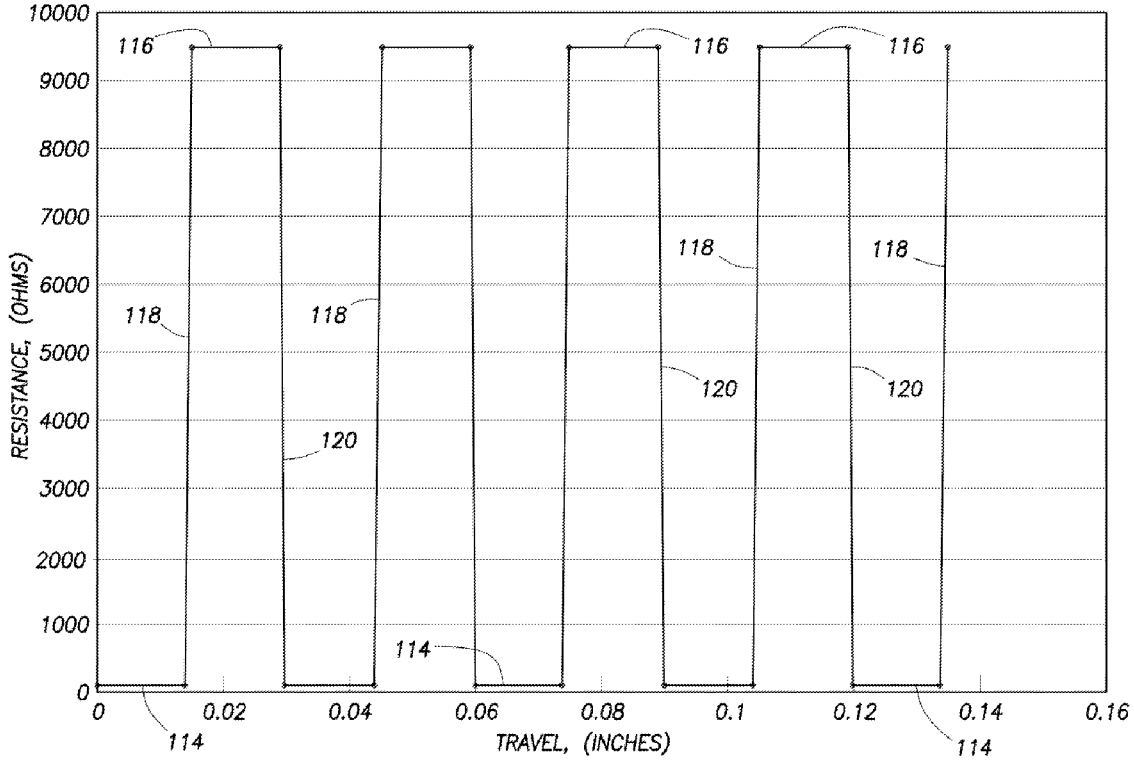
FIG. 20 is a graph of resistance versus travel for the resistive element of FIG. 19.

A graph of resistance versus travel is representatively illustrated in FIG. 20 for the resistive element 102 configuration of FIG. 19. The relatively low resistance 114 indicated in the graph occurs when the contact fingers 106 are in contact with the conductive strips 108, and the relatively high resistance 116 occurs when the contact fingers are in contact with the insulative material 112 between the conductive strips.

It will be appreciated that, by counting the occurrences of the relatively low and high resistances 114, 116, or their associated rising or falling edges 118, 120 (which may be detected using the voltmeter 86), the position of the contacts 104 and sleeve 34 relative to the resistive element 102 can be readily determined. Furthermore, different spacings between the conductive strips 108, different resistance values, etc. may be used in the resistive element 102 to provide additional positive indications of the position of the sleeve 34.

Figure 21:
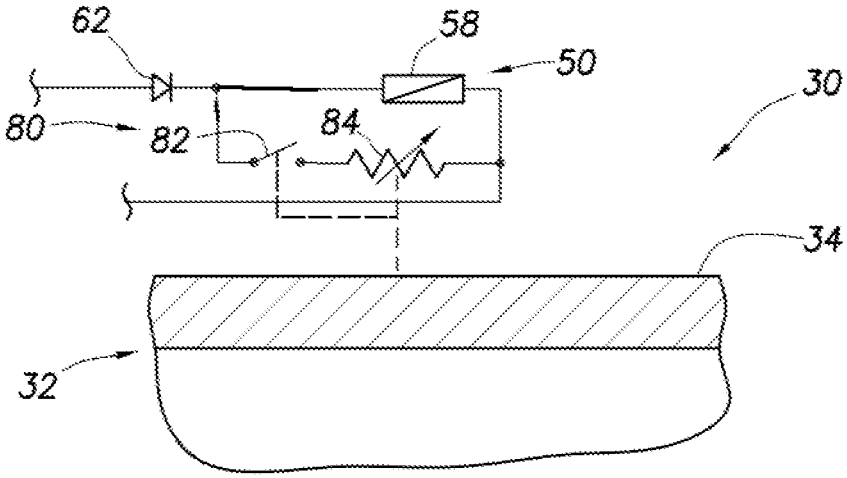
FIG. 21 is a schematic electrical diagram showing another configuration of the position indicator.

Referring additionally now to FIG. 21, another configuration of the position indicator 80 in the system 30 is representatively illustrated. In this configuration, the resistance 84 varies with displacement of the sleeve 34 as in the configuration of FIG. 18, except that the value of the resistance also changes with displacement of the sleeve.

The position indicator 80 of FIG. 21 also includes the switch 82 which alternately opens and closes in response to displacement of the sleeve 34. The switch 82 may be actuated in any manner, including as described above for the configurations of FIGS. 13 & 14.

Figure 22:
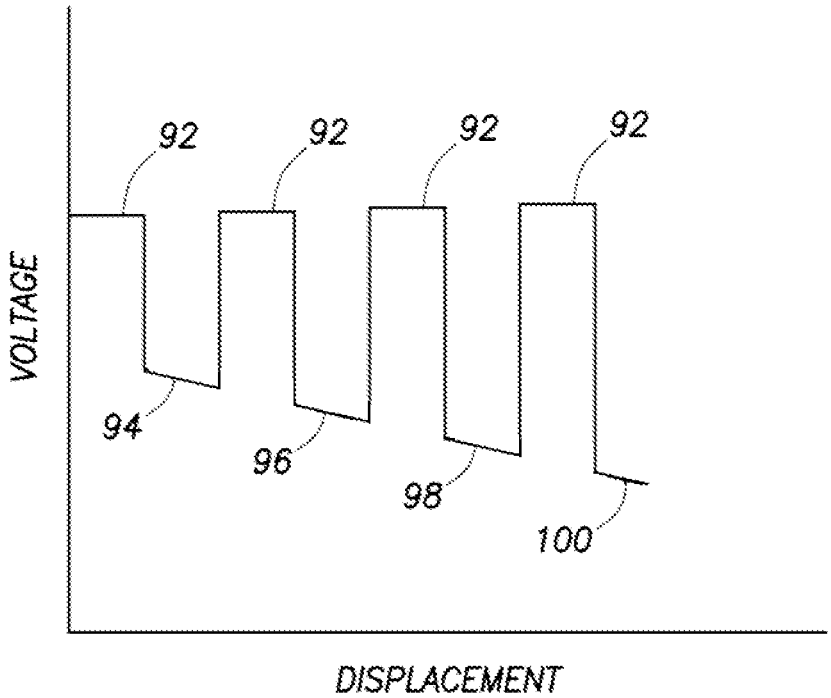
FIG. 22 is a graph of resistance versus travel for the resistive element of FIG. 21.

In FIG. 22, a graph of voltage versus displacement of the sleeve 34 is representatively illustrated for the position indicator 80 configuration of FIG. 21. Note that the graph of FIG. 22 is similar to the graph of FIG. 17, except that the voltages 94, 96, 98, 100 indicated by the voltmeter 86 when the switch 82 is closed are sloped. This is due to the fact that the value of the resistance 84 varies as the sleeve 34 displaces. Thus, the position of the sleeve 34 can be conveniently determined, not only by the number of voltage changes, but also by the value of the voltage when the switch 82 is closed.

It may now be fully appreciated that the above disclosure provides many advancements to the art of controlling operation of multiplexed well tools, including determining positions of the well tools. The configuration of a well tool 32 (such as the position of the sleeve 34 therein) can be conveniently indicated at a remote location (such as the earth's surface, etc.) by monitoring voltage across conductors 52 extending from a constant direct current power supply 64 (which can also include some alternating current, signals, etc., as discussed above) to a control device 50 for each of the well tools.

The above disclosure describes a method of selectively actuating and indicating a position (for example, a position of a well tool) in a well, with the method comprising the steps of: selecting at least one well tool 32 from among multiple well tools 32 for actuation by flowing direct current in a first direction through a set of conductors 52 in the well, the well tool 32 being deselected for actuation when direct current flows through the set of conductors 52 in a second direction opposite to the first direction; and detecting a varying resistance across the set of conductors 52 as the selected well tool 32 is actuated. The variation in resistance provides an indication of a position of a portion (for example, the sleeve 34) of the selected well tool 32.

Providing the indication of the position of the portion 34 of the selected well tool 32 may include monitoring a voltage across the set of conductors 52, with the set of conductors 52 being connected to a power supply 64 which supplies the direct current. The power supply 64 may supply constant direct current to the set of conductors 52.

A position indicator 80 including a variable resistance resistor 84 may be connected in parallel with another resistance (such as the solenoid 58 or coil 74) in a control device 50 for the selected well tool 32. The variable resistance resistor 84 may include a resistive element 102 comprising electrical contacts 104 which alternately contact insulative and conductive materials 110, 112 as the selected well tool 32 is actuated, thereby varying electrical resistance across the resistive element 102. The portion of the selected well tool 32 may include a sleeve 34, displacement of which varies fluid flow through the well tool 32, and the contacts 104 may displace with the sleeve 34.

A position indicator 80 including a resistor 84 and a switch 82 may be connected in parallel with another resistance (such as a solenoid 58 or coil 74) in a control device 50 for the selected well tool 32. The switch 82 may be actuated as the portion 34 of the selected well tool 32 displaces.

Also described by the above disclosure is a system 30 for selectively actuating from a remote location multiple downhole well tools 32 in a well. The system 30 includes multiple electrical conductors 52 in the well; multiple control devices 50 that control which of the well tools 32 is selected for actuation in response to current flow in at least one set of the conductors 52, at least one direction of current flow in the at least one set of conductors 52 being operative to select a respective at least one of the well tools 32 for actuation; and multiple position indicators 80. Each position indicator 80 is operative to indicate a position of a portion 34 of a respective one of the well tools 32.

Each position indicator 80 may vary a resistance across the control device 50 of the respective well tool 32 as the portion 34 of the respective well tool 32 displaces.

Each position indicator 80 may include a switch 82 and a resistor 84. The switch 82 may alternately open and close, the resistor 84 being thereby intermittently placed in parallel with another resistance (such as solenoid 58 or coil 74) of the respective control device 50, as the portion 34 of the respective well tool 32 displaces.

Each position indicator 80 may include multiple switches 82 and a resistor 84. The switches 82 may be successively opened and closed, and the resistor 84 may be thereby intermittently placed in parallel with another resistance (such as solenoid 58 or coil 74) of the respective control device 50, as the portion 34 of the respective well tool 32 displaces.

Each position indicator 80 may include multiple switches 82 and multiple resistors 84. The switches 82 may be successively opened and closed, and varying numbers of the resistors 84 may be thereby intermittently placed in parallel with another resistance 9 such as solenoid 58 or coil 74) of the respective control device 50, as the portion 34 of the respective well tool 32 displaces.

Each position indicator 80 may include a variable resistance resistor 84 connected in parallel with another resistance (such as solenoid 58 or coil 74) of the respective control device 50. The variable resistance resistor 84 may include a resistive element 102 comprising electrical contacts 104 which alternately contact insulative and conductive materials 110, 112 as the respective well tool 32 is actuated, thereby varying electrical resistance across the resistive element 102. The portion of the respective well tool 32 may comprise a sleeve 34, displacement of which varies fluid flow through the respective well tool 32, and the contacts 104 may displace with the sleeve 34.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of selectively actuating at least one well tool in a well and indicating a position of a portion of the well tool, the method comprising the steps of:

selecting the well tool from among multiple well tools for actuation by flowing direct current in a first direction through a set of conductors in the well, wherein the well tool is not selected for actuation when direct current flows through the set of conductors in a second direction opposite to the first direction; and detecting a varying resistance across the set of conductors as the selected well tool is actuated, the variation in resistance providing an indication of at least one intermediate position of the portion of the selected well tool as the portion displaces during actuation of the selected well tool.

2. The method of claim 1, wherein the step of providing the indication of the position of the portion of the selected well tool comprises monitoring a voltage across the set of conductors, with the set of conductors being connected to a power supply which supplies the direct current.

3. The method of claim 2, wherein the power supply supplies constant direct current to the set of conductors.

4. The method of claim 1, wherein a position indicator including a variable resistance resistor is connected in parallel with another resistance in a control device for the selected well tool.

5. The method of claim 1, wherein a position indicator including a resistor and a switch is connected in parallel with another resistance in a control device for the selected well tool, and wherein the switch is actuated as the portion of the selected well tool displaces.

6. A method of selectively actuating and indicating a position in a well, the method comprising the steps of:

selecting at least one well tool from among multiple well tools for actuation by flowing direct current in a first direction through a set of conductors in the well, the well tool being deselected for actuation when direct current flows through the set of conductors in a second direction opposite to the first direction; and detecting a varying resistance across the set of conductors as the selected well tool is actuated, the variation in resistance providing an indication of a position of a portion of the selected well tool, wherein a position indicator including a variable resistance resistor is connected in parallel with another resistance in a control device for the selected well tool, wherein the variable resistance resistor includes a resistive element comprising electrical contacts which alternately contact insulative and conductive materials as the selected well tool is actuated, thereby varying electrical resistance across the resistive element.

7. The method of claim 6, wherein the portion of the selected well tool comprises a sleeve, displacement of which varies fluid flow through the well tool, and wherein the contacts displace with the sleeve.

8. A system for selectively actuating from a remote location multiple downhole well tools in a well, the system comprising:

multiple electrical conductors in the well;

multiple control devices that control which of the well tools is selected for actuation in response to current flow in at least one set of the conductors, current flow in a first direction in the set of conductors being operative to select a respective one of the well tools for actuation, and current flow in a second direction opposite to the first direction in the set of conductors being operative to select a different respective one of the well tools for actuation and being operative to deselect the respective one of the well tools for actuation; and multiple position indicators, each position indicator being operative to indicate at least one intermediate position of a respective portion of each of the well tools as the respective portion displaces during actuation of the respective well tool.

9. The system of claim 8, wherein each position indicator varies a resistance across the control device of the respective well tool as the portion of the respective well tool displaces.

10. The system of claim 8, wherein each position indicator includes a switch and a resistor, and wherein the switch alternately opens and closes, and the resistor is thereby intermittently placed in parallel with another resistance of the respective control device, as the portion of the respective well tool displaces.

11. The system of claim 8, wherein each position indicator includes multiple switches and a resistor, and wherein the switches are successively opened and closed, and the resistor is thereby intermittently placed in parallel with another resistance of the respective control device, as the portion of the respective well tool displaces.

12. The system of claim 8, wherein each position indicator includes multiple switches and multiple resistors, and wherein the switches are successively opened and closed, and varying numbers of the resistors are thereby intermittently placed in parallel with another resistance of the respective control device, as the portion of the respective well tool displaces.

13. The system of claim 8, wherein each position indicator includes a variable resistance resistor connected in parallel with another resistance of the respective control device.

14. A system for selectively actuating from a remote location multiple downhole well tools in a well, the system comprising:

multiple electrical conductors in the well;

multiple control devices that control which of the well tools is selected for actuation in response to current flow in at least one set of the conductors, at least one direction of current flow in the at least one set of conductors being operative to select a respective at least one of the well tools for actuation; and multiple position indicators, each position indicator being operative to indicate a position of a respective portion of each of the well tools, wherein each position indicator includes a variable resistance resistor connected in parallel with another resistance of the respective control device, wherein the variable resistance resistor includes a resistive element comprising electrical contacts which alternately contact insulative and conductive materials as the respective well tool is actuated, thereby varying electrical resistance across the resistive element.

15. The system of claim 14, wherein the portion of the respective well tool comprises a sleeve, displacement of which varies fluid flow through the respective well tool, and wherein the contacts displace with the sleeve.

* * * * *